US008336877B2

(12) United States Patent
Yamamoto et al.

(10) Patent No.: US 8,336,877 B2
(45) Date of Patent: Dec. 25, 2012

(54) MEDIUM DISCHARGING DEVICE AND IMAGE FORMING APPARATUS

(75) Inventors: Toshiaki Yamamoto, Kanagawa (JP); Hiroyuki Nakamura, Kanagawa (JP); Kiyomi Nakamura, legal representative, Yokohama (JP); Youetsu Oyama, Kanagawa (JP); Akihiro Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 233 days.

(21) Appl. No.: 12/491,718

(22) Filed: Jun. 25, 2009

(65) Prior Publication Data

US 2010/0025928 A1 Feb. 4, 2010

(30) Foreign Application Priority Data

Aug. 4, 2008 (JP) ..... P2008-201127

(51) Int. Cl.
*B65H 31/00* (2006.01)

(52) U.S. Cl. ..... 271/207; 271/200

(58) Field of Classification Search ..... 271/200, 271/207, 314; 414/791.2
See application file for complete search history.

(56) References Cited

U.S. PATENT DOCUMENTS

| | | | | | |
|---|---|---|---|---|---|
| 4,429,866 | A * | 2/1984 | Castro-Hahn | 271/266 |
| 4,580,774 | A * | 4/1986 | Yamaguchi et al. | 271/176 |
| 4,858,909 | A * | 8/1989 | Stemmle | 271/184 |
| 5,031,893 | A * | 7/1991 | Yoneda et al. | 271/65 |
| 5,037,081 | A * | 8/1991 | Engelhardt et al. | 271/207 |
| 5,465,955 | A * | 11/1995 | Krupica et al. | 271/265.02 |
| 5,489,092 | A * | 2/1996 | Kimura et al. | 271/185 |
| 7,963,524 | B2 * | 6/2011 | Ohta | 271/213 |
| 2004/0156032 | A1 * | 8/2004 | Murakami et al. | 355/407 |
| 2006/0181006 | A1 * | 8/2006 | Funada | 271/207 |
| 2009/0200736 | A1 * | 8/2009 | Seki | 271/314 |

FOREIGN PATENT DOCUMENTS

| | | | |
|---|---|---|---|
| GB | 2059394 | A * | 4/1981 |
| JP | 3-42460 | A | 2/1991 |
| JP | 03088667 | A * | 4/1991 |
| JP | 5-221575 | A | 8/1993 |
| JP | 2005-96889 | A | 4/2005 |
| JP | 2006-21843 | A | 1/2006 |

* cited by examiner

*Primary Examiner* — Prasad Gokhale
(74) *Attorney, Agent, or Firm* — Morgan, Lewis & Bockius LLP

(57) ABSTRACT

A medium discharging device includes a medium stacking portion, a medium discharge member and a moving mechanism. A medium having an image recorded thereon is to be stacked on the medium stacking portion. The medium discharge member discharges the medium to the medium stacking portion. The moving mechanism includes a separation member. Based on a discharge timing at which the medium is discharged from the medium discharge member, the separation member moves the medium discharge member between an advanced position at a downstream end in the medium conveyance direction and a retracted position that is located upstream of the advanced position in the medium conveyance direction, to separate from the medium discharge member a rear end of the discharged medium in the medium conveyance direction.

16 Claims, 11 Drawing Sheets

Flowchart of process of controlling rear-end separating member in Example 1

Flowchart of process of controlling adjustment member in Example 1

Flowchart of process of controlling rear-end separating member in Example 2

MEDIUM DISCHARGING DEVICE AND IMAGE FORMING APPARATUS

CROSS-REFERENCE TO RELATED APPLICATIONS

This application is based on and claims priority under 35 USC 119 from Japanese Patent Application No. 2008-201127 filed on Aug. 4, 2008.

BACKGROUND

1. Technical Field

The invention relates to a medium discharging device and an image forming apparatus.

2. Related Art

An image forming apparatus having a discharge roll that discharges onto a discharge tray a medium on which an image is recorded has been known.

SUMMARY

According to an aspect of the invention, a medium discharging device includes a medium stacking portion, a medium discharge member and a moving mechanism. A medium having an image recorded thereon is to be stacked on the medium stacking portion. The medium discharge member discharges the medium to the medium stacking portion. The moving mechanism includes an adjustment member and a separation member. The adjustment member moves the medium discharge member and the medium, which is being discharged, in a medium width direction that is perpendicular to a medium conveyance direction, to adjust a stack position where the medium, which is being discharged, is to be stacked on the medium stacking portion. Based on a discharge timing at which the medium is discharged from the medium discharge member, the separation member moves the medium discharge member between an advanced position at a downstream end in the medium conveyance direction and a retracted position that is located upstream of the advanced position in the medium conveyance direction, to separate from the medium discharge member a rear end of the discharged medium in the medium conveyance direction.

BRIEF DESCRIPTION OF THE DRAWINGS

Exemplary embodiments of the invention will be described below in detail based on accompanying drawings, wherein:

FIG. 4A is a diagram of the offset mechanism as seen from the upper side, and FIG. 4B is a diagram of the offset mechanism as seen from a direction of an arrow IVB in FIG. 4A;

FIG. 8A is a diagram showing a state where a discharge path sensor detects a rear end, in a medium conveyance direction, of a recording sheet which is discharged by a inversion roll, FIG. 8B is a diagram showing a state following the state of FIG. 8A where the rear end, in the medium conveyance direction, of the recording sheet, which is discharged by the inversion roll, remains in the inversion roll, FIG. 8C is a diagram showing a state following the state of FIG. 8B where the inversion roll is moved from an advanced position to a retracted position, and the recording sheet is dropped, and FIG. 8D is a diagram showing a state where a rear end, in the medium conveyance direction, of a recording sheet, which is larger than in sheet size than those of FIGS. 8A to 8C remains in the inversion roll;

FIG. 11A is a diagram showing a state where a rear end, in the medium conveyance direction, of a recording sheet which is discharged by a inversion roll remains in the inversion roll, FIG. 11B is a diagram showing a state following the state of FIG. 11A where the inversion roll is moved from a retracted position to an advanced position, and FIG. 11C is a diagram showing a state following the state of FIG. 11B where the inversion roll is moved from the advanced position to the retracted position, and the recording sheet is dropped.

DETAILED DESCRIPTION

Figure 1:
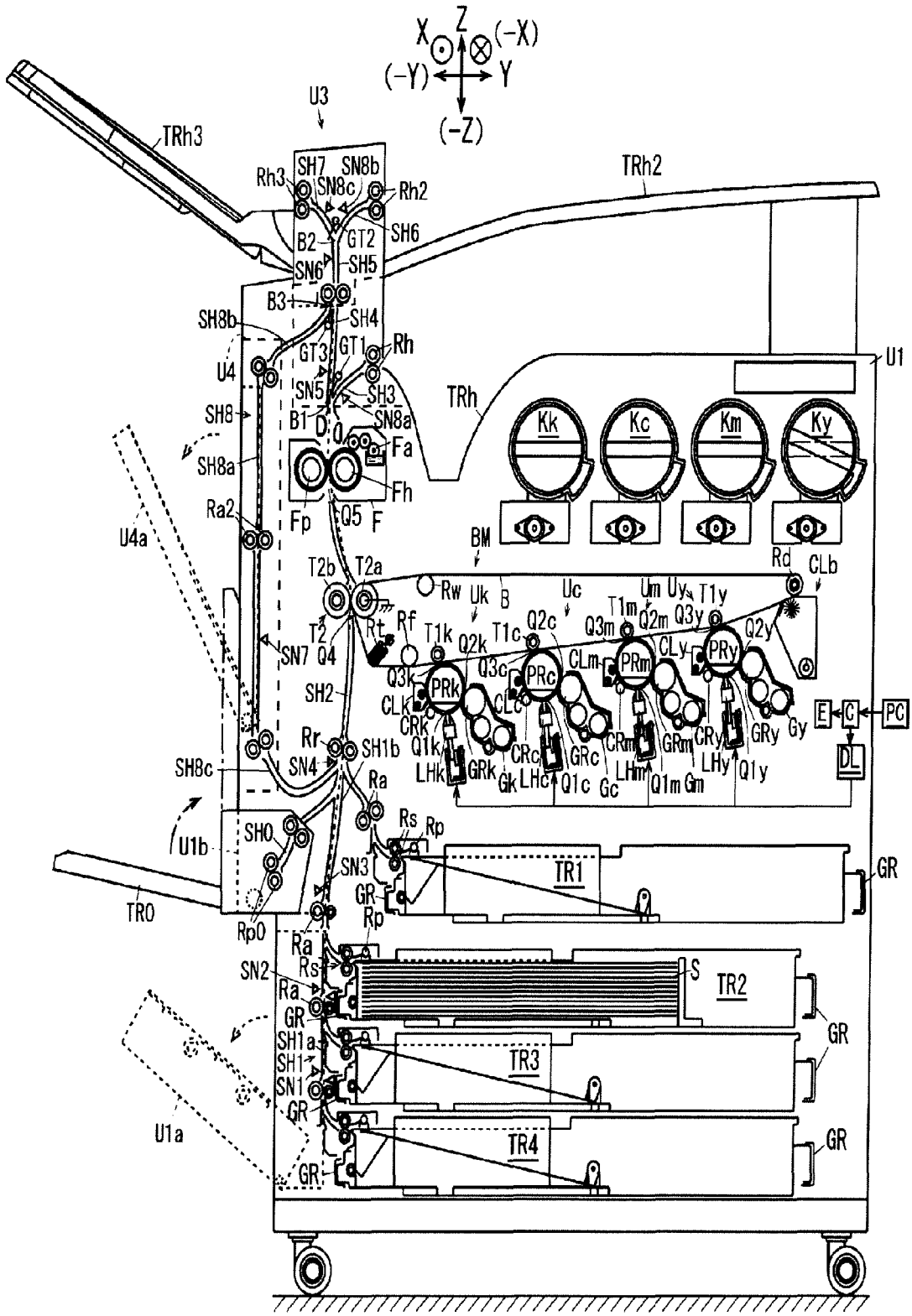
FIG. 1 is an overall view illustrating an image forming apparatus of Example 1 of the invention.

Next, specific examples of an exemplary embodiment of the invention will be described with reference to the accompanying drawings. It should be noted that the invention is not limited to the following examples.

In order to facilitate the understanding of the following description, the front and rear directions of the drawing paper are indicated as X-axis directions, the right and left directions of the drawings are indicated as Y-axis directions, and the upper and lower directions of the drawings are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "○" indicates an arrow which is directed from the rear of the sheet to the front thereof, and the symbol in which "x" is written in "○" indicates an arrow which is directed from the front of the sheet to the rear.

In the following description with reference to the drawings, illustrations of members other than those which are necessary to describe the examples may be omitted for the sake of easy understanding.

Example 1

FIG. 1 is a diagram illustrating the whole of an image forming apparatus of Example 1 of the invention.

Referring to FIG. 1, a printer U which is an example of the image forming apparatus of Example 1 of the invention includes an image forming apparatus body U1. Image information transmitted from an image information transmitting apparatus PC which is electrically connected to the printer U is input into a controller C. The image information, which is input into the controller C, is converted at a given timing into image information of yellow Y, magenta M, cyan C, and black K for forming a latent image, and then output to a latent-image forming device driving circuit DL.

When an original image is a single-color image or a so-called monochromatic image, only image information of black K is supplied to the latent-image forming device driving circuit DL.

The latent-image forming device driving circuit DL has driving circuits (not shown) for the respective colors Y, M, C, and K, and supplies signals corresponding to the input image information at given timings, to latent-image forming devices LHy, LHm, LHc, LHk which are provided for the respective colors.

Referring to FIG. 1, visible-image forming devices Uy, Um, Uc, Uk which are placed in a middle portion in the gravitational direction of the printer U form visible images of the colors Y, M, C, and K, respectively.

Latent-image writing beams Ly, Lm, Lc, and Lk of Y, M, C, and K emitted from latent-image writing light sources of the latent-image forming devices LHy to LHk are incident on rotary image carriers PRy, PRm, PRc, PRk, respectively. In Example 1, the latent-image forming devices LHy to LHk are configured by so-called LED arrays, respectively.

The image forming apparatus Uy for Y has the rotary image carrier PRy, a charging device CRy, the latent-image forming device LHy, a developing device Gy, a primary transfer device T1*y*, and an image-carrier cleaner CLy. In Example 1, the image carrier PRy, the charging device CRy, and the image-carrier cleaner CLy are configured as an image carrier unit which is integrally detachable from the image forming apparatus body U1.

The visible-image forming devices Um, Uc, Uk are configured in a similar manner as the visible-image forming device Uy for Y.

Referring to FIG. 1, the image carriers PRy, PRm, PRc, PRk are charged by the respective charger devices CRy, CRm, CRc, CRk, and, at image writing stations Q1*y*, Q1*m*, Q1*c*, Q1*k*, electrostatic latent images are then formed in their surfaces by the latent-image writing beams Ly, Lm, Lc, Lk. In developing regions Q2*y*, Q2*m*, Q2*c*, Q2*k*, the electrostatic latent images in the surfaces of the image carriers PRy, PRm, PRc, PRk are developed into toner images which are examples of visible images, with developers held by developing rolls GRy, GRm, GRc, GRk which are examples of developer carriers of the developing devices Gy, Gm, Gc, Gk.

The developed toner images are conveyed to primary transferring regions Q3*y*, Q3*m*, Q3*c*, Q3*k* which are in contact with an intermediate transfer belt B that is an example of an intermediate transferring member. At a given timing, a power source circuit E which is controlled by a controller C applies a primary transfer voltage having an opposite polarity to the charging polarity of the toner, to primary transfer devices T1*y*, T1*m*, T1*c*, T1*k* placed on the rear face side of the intermediate transfer belt B in the primary transferring regions Q3*y*, Q3*m*, Q3*c*, Q3*k*.

The toner images on the image carriers PRy to PRk are primarily transferred to the intermediate transfer belt B by the primary transfer devices T1*y*, T1*m*, T1*c*, T1*k*. Residuals and adhesions on the surfaces of the image carriers PRy, PRm, PRc, PRk after the primary transfer are cleaned by the image-carrier cleaners CLy, CLm, CLc, CLk. The surfaces of the image carriers PRy, PRm, PRc, PRk, which have been cleaned, are again charged by the charging devices CRy, CRm, CRc, CRk.

A belt module BM which is an example of an intermediate transfer device, and which is vertically movable and forward extractable is placed above the image carriers PRy to PRk. The belt module BM has: the intermediate transfer belt B; a belt driving roll Rd which is an example of an intermediate-transferring member driving member; a tension roll Rt which is an example of an intermediate-transferring member stretching member; a walking roll Rw which is an example of a meandering preventing member; an idler roll Rf which is an example of a driven member; a backup roll T2*a* which is an example of a secondary-transfer region opposing member; and the primary transfer devices T1*y*, T1*m*, T1*c*, T1*k*. The intermediate transfer belt B is supported in a rotary movable manner by the belt supporting rolls Rd, Rt, Rw, Rf, T2*a* which are examples of an intermediate-transferring member support member configured by the rolls Rd, Rt, Rw, Rf, T2*a*.

A secondary transfer roll T2*b* which is an example of a secondary transfer member is placed while opposing to the surface of the intermediate transfer belt B contacted with the backup roll T2*a*. A secondary transfer device T2 is configured by the rolls T2*a*, T2*b*. A secondary transferring region Q4 is formed in a region where the secondary transfer device T2 and the intermediate transfer belt B are opposed to each other.

The single- or multi-color toner images which are sequentially stackingly transferred onto the intermediate transfer belt B by the primary transfer devices T1*y*, T1*m*, T1*c*, T1*k* in the primary transferring regions Q3*y*, Q3*m*, Q3*c*, Q3*k* are conveyed to the secondary transferring region Q4.

A transfer device (T1+T2+B) of Example 1 is configured by the primary transfer devices T1*y* to T1*k*, the intermediate transfer belt B, the secondary transfer device T2, etc.

Four pairs of right and left guide rails GR which are examples of a guiding member are disposed below the visible-image forming devices Uy to Uk. Sheet feeding trays TR1 to TR4 which are examples of a sheet feeding container are supported by the guide rails GR so as to be movable in the anteroposterior direction. Recording sheets S which are examples of media housed in the sheet feeding trays TR1 to TR4 are taken out by a pickup roll Rp which is an example of a conveying member, and which is an example of a medium taking out member, and separated one by one by a separating roll Rs which is an example of a medium separating member. Then, the recording sheet S is conveyed by plural conveyance rolls Ra which are examples of the conveying member, along a sheet conveyance path SH1 which is an example of a medium conveyance path, and sent to a registration roll Rr which is an example of a transfer-region conveyance timing adjusting member, and which is disposed on the upstream side of the secondary transferring region Q4 in the sheet conveying direction. A sheet feeding device (Rp+Rs) in Example 1 is configured by the pickup roll Rp, the separating roll Rs, etc.

A manual feed tray TR0 which is an example of a manual sheet feeding portion is disposed on the left of the uppermost sheet feeding tray TR1. The recording sheet S supported by the manual feed tray TR0 is fed by a manual sheet feeding roll Rp0 which is an example of a manual sheet feeding member, conveyed through a manual conveyance path SH0, and sent to the registration roll Rr.

In timing with the conveyance of the toner image formed on the intermediate transfer belt B to the secondary transferring region Q4, the registration roll Rr conveys the recording sheet S is conveyed to a main conveyance path SH2 which is an example of the conveyance path on the downstream side of the sheet conveyance path SH1, and conveys the recording sheet S to the secondary transferring region Q4. When the recording sheet S is passed through the secondary transferring region Q4, the backup roll T2*a* is grounded, and the power source circuit E which is controlled by the controller C applies a secondary transfer voltage which is opposite to the charging polarity of the toner, to the secondary transfer device T2. At this time, the toner image on the intermediate transfer belt B is transferred to the recording sheet S by the secondary transfer device T2.

After the secondary transfer, the intermediate transfer belt B is cleaned by a belt cleaner CLb which is an example of an intermediate-transferring member cleaner.

The recording sheet S on which the toner image has been secondarily transferred is conveyed to a fixing region Q5 which is a press contact region between a heating roll Fh that is an example of a heating fixing member of a fixing device F, and a pressuring roll Fp that is an example of a pressuring fixing member, and subjected to heating fixation when passed through the fixing region. A release agent which improves the property of releasing of the recording sheet S from the heating roll is applied to the surface of the heating roll Fh by a release-agent applying device Fa.

An image recording device (Uy to Uk+BM+T2+F) in Example 1 is configured by the visible-image forming devices Uy to Uk, the belt module BM, the secondary transfer device T2, the fixing device F, etc.

A sheet discharging path SH3 which is an example of a first medium discharging path in the case where the recording sheet S is to be conveyed to a sheet discharging tray TRh which is an example of a first medium stacking portion, and an upper connecting path SH4 which is an example of an branch conveyance path for conveying the recording sheet S that is discharged while being inverted or directing the image recording face upward are placed in the upper side which is on the downstream side of the fixing device F. A first gate GT1 which is an example of a conveyance path switching member for switching the conveyance path in accordance with the conveyance destination of the recording sheet S is placed in a branching portion B1 to which the sheet discharging path SH3 and the upper connecting path SH4 are connected. When the sheet is to be discharged to the sheet discharging tray TRh, therefore, the fixed recording sheet S is conveyed through the sheet discharging path SH3, and discharged to the sheet discharging tray TRh by a discharge roller Rh which is an example of a first medium discharge member.

Figure 2:
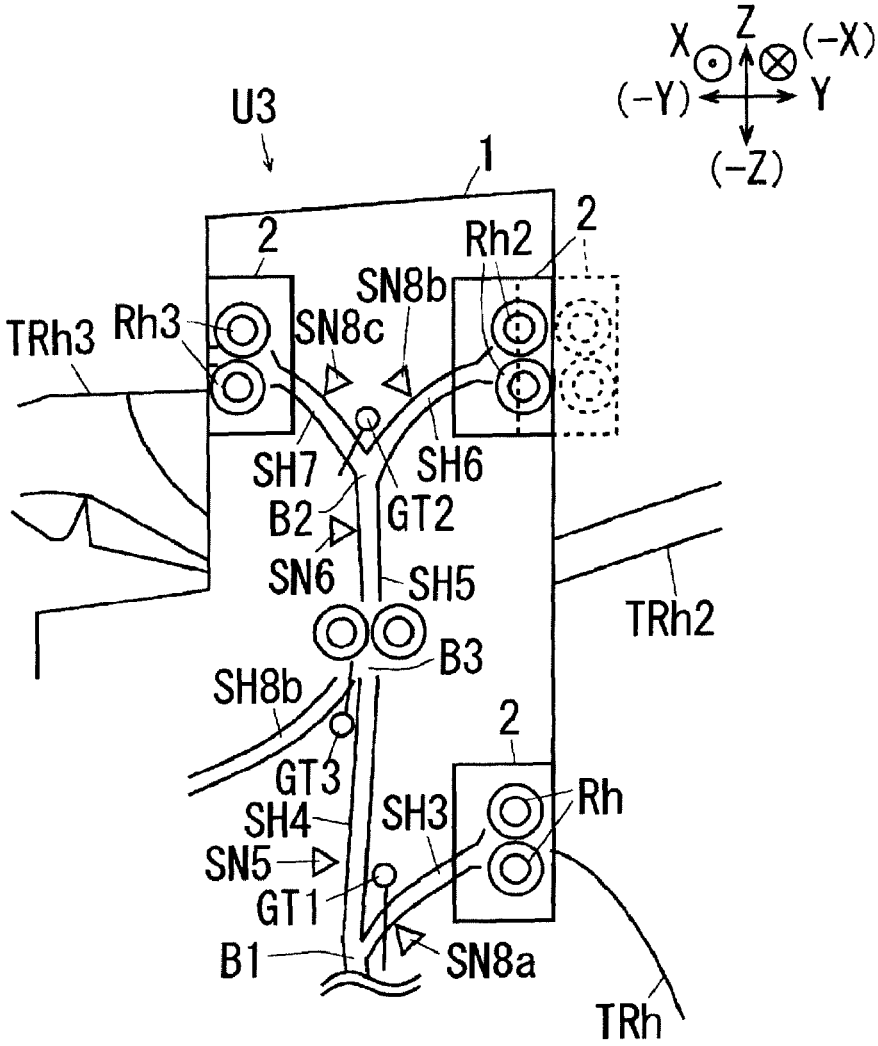
FIG. 2 is a view illustrating main portions of a medium discharging device of Example 1.

FIG. 2 is a view illustrating main portions of a medium discharging device of Example 1.

Referring to FIGS. 1 and 2, an option discharge unit U3 which is an example of the medium discharging device is supported above the fixing device F. The option discharge unit U3 has: a face-down tray TRh2 that is placed above the sheet discharging tray TRh, and that is an example of a second medium discharge member on which, in a similar manner as the sheet discharging tray TRh, the sheet is stacked while directing the image recording face downward; and a face-up tray TRh3 that is an example of a third medium discharge member on which the sheet is stacked while directing the image recording face upward.

The option discharge unit U3 includes, therein, an inverting/discharging common path SH5 which is an example of a conveyance path that is connected to the upper connecting path SH4, a face-down discharging path SH6 which is an example of a conveyance path that is connected to the inverting/discharging common path SH5, and that sends the recording sheet S to the face-down tray TRh2, and a face-up discharging path SH7 which is an example of a conveyance path that is connected to the inverting/discharging common path SH5, and that sends the recording sheet S to the face-up tray TRh3. A inversion roll Rh2, which is an example of a second medium discharge member and an example of a medium inverting member and which can rotate forwardly and reversely, is placed in the face-down discharging path SH6. A face-up discharge roll Rh3 which is an example of a third medium discharge member is placed in the face-up discharging path SH7. With this configuration, the recording sheet S in the discharging path SH6 or SH7 is conveyed.

A second gate GT2 which is an example of the conveyance path switching member for switching the conveyance path for the recording sheet S is placed in a branching portion B2 for the inverting/discharging common path SH5, the face-down discharging path SH6, and the face-up discharging path SH7. In the case where the recording sheet S is to be discharged onto the face-down tray TRh2, or where the sheet is to be inverted for double-sided printing, the second gate GT2 switches the conveyance path to the face-down discharging path SH6. In the case where the recording sheet S is to be discharged onto the face-up tray TRh3, the second gate GT2 switches the conveyance path to the face-up discharging path SH7.

A second medium discharging path (SH4+SH5+SH6) in Example 1 is configured by the upper connecting path SH4, the inverting/discharging common path SH5, and the face-down discharging path SH6.

A third medium discharging path (SH4+SH5+SH7) in Example 1 is configured by the upper connecting path SH4, the inverting/discharging common path SH5, and the face-up discharging path SH7.

An inverting unit U4 which is an example of an additional unit is disposed in the left portion of the image forming apparatus body U1. The inverting unit U4 is connected to a lower end portion of the inverting/discharging common path SH5. An inverting path SH8 that is an example of a conveyance path through which the recording sheet S is conveyed in double-sided printing is disposed in the inverting unit. The inverting path SH8 has: a main inverting path SH8*a* which linearly extends in the gravitational direction; an upstream inverting path SH8*b* through which the main inverting path SH8*a* is connected to the inverting/discharging common path SH5; and a downstream inverting path SH8*c* through which the main inverting path SH8*a* is connected to the registration roll Rr. A third gate GT3 which is an example of a conveyance path switching member which switches the conveyance path so that, in the inverting process, the recording sheet S is not conveyed to the upper connecting path SH4 is placed in a connecting portion B3 between the upstream inverting path SH8*b* and the inverting/discharging common path SH5. An inverting-path discharge roll Ra2 which is an example of an inverting-path conveying member for conveying the recording sheet S in the inverting path SH8 is placed in the inverting path SH8 which is a downstream conveyance path in the conveying direction with respect to the inverting/discharging common path SH5 and the face-down discharging path SH6.

Therefore, the recording sheet S which is to be subjected double-sided printing is conveyed through the inverting/discharging common path SH5 to be discharged onto the face-down tray TRh2 until a rear end portion of the recording sheet S is clamped by the inversion roll Rh2, and then the inversion roll Rh2 is reversely rotated to convey the recording sheet S into the inverting path SH8. The recording sheet S which has been conveyed through the inverting path SH8 is further conveyed by the inverting-path discharge roll Ra2, and conveyed to the registration roll Rr in an inverted state.

Referring to FIG. 1, first, second, third, and fourth sheet feeding path sensors SN1, SN2, SN3, SN4 which are examples of a medium detecting member for detecting the recording sheet S fed from the sheet feeding trays TR1 to TR4 are placed in the sheet conveyance path SH1. As an example of the medium detecting member, a connecting path sensor SN5, a common path sensor SN6, an inverting path sensor SN7, and discharge path sensors SN8*a* to SN8*c* are placed for detecting the recording sheet S in the upper connecting path SH4, the inverting/discharging common path SH5, the main inverting path SH8*a*, and the discharging paths SH3, SH6, SH7, respectively.

Referring to FIG. 1, in Example 1, a lower cover U1*a* which is an example of an upstream opening member is supported openably and closably between a normal position indicated by the solid line in FIG. 1, and an open position indicated by the broken line in FIG. 1, on the left side of the lower three sheet feeding trays TR2 to TR4. A left guiding member or so-called guide for the sheet conveyance path SH1 on the left side of the sheet feeding trays TR2 to TR4, and the outsides of the pair of conveyance rolls Ra are supported on the lower cover U1*a*. When the lower cover U1*a* is moved to the open position, therefore, the lower portion of the sheet conveyance path SH1, i.e., an upstream sheet conveyance path SH1*a* on the upstream side in the conveying direction is opened.

Referring to FIG. 1, in the inverting unit U4, as an example of a downstream opening member, an inverting-path opening cover U4*a* which is supported openably and closably between a normal position indicated by the solid line in FIG. 1, and an open position indicated by the broken line in FIG. 1 is placed on the left of the main inverting path SH8*a*. A left guide of the main inverting path SH8*a* is supported on the inverting-path opening cover U4*a*. When the inverting-path opening cover U4*a* is moved to the open position, the main inverting path SH8*a* is opened.

Developer cartridges Ky, Km, Kc, Kk which are examples of developer replenishment containers respectively housing developers of yellow Y, magenta M, cyan C, and black K are arranged above the belt module BM. The developers housed in the developer cartridges Ky, Km, Kc, Kk are replenished to the developing devices Gy, Gm, Gc, Gk in accordance with consumptions of the developers of the developing devices Gy, Gm, Gc, Gk, through developer replenishment paths which are not shown. In Example 1, each of the developers is configured by a two-component developer containing a magnetic carrier, and a toner to which an external additive is added.

(Description of Option Discharge Unit U3)

Figure 3:
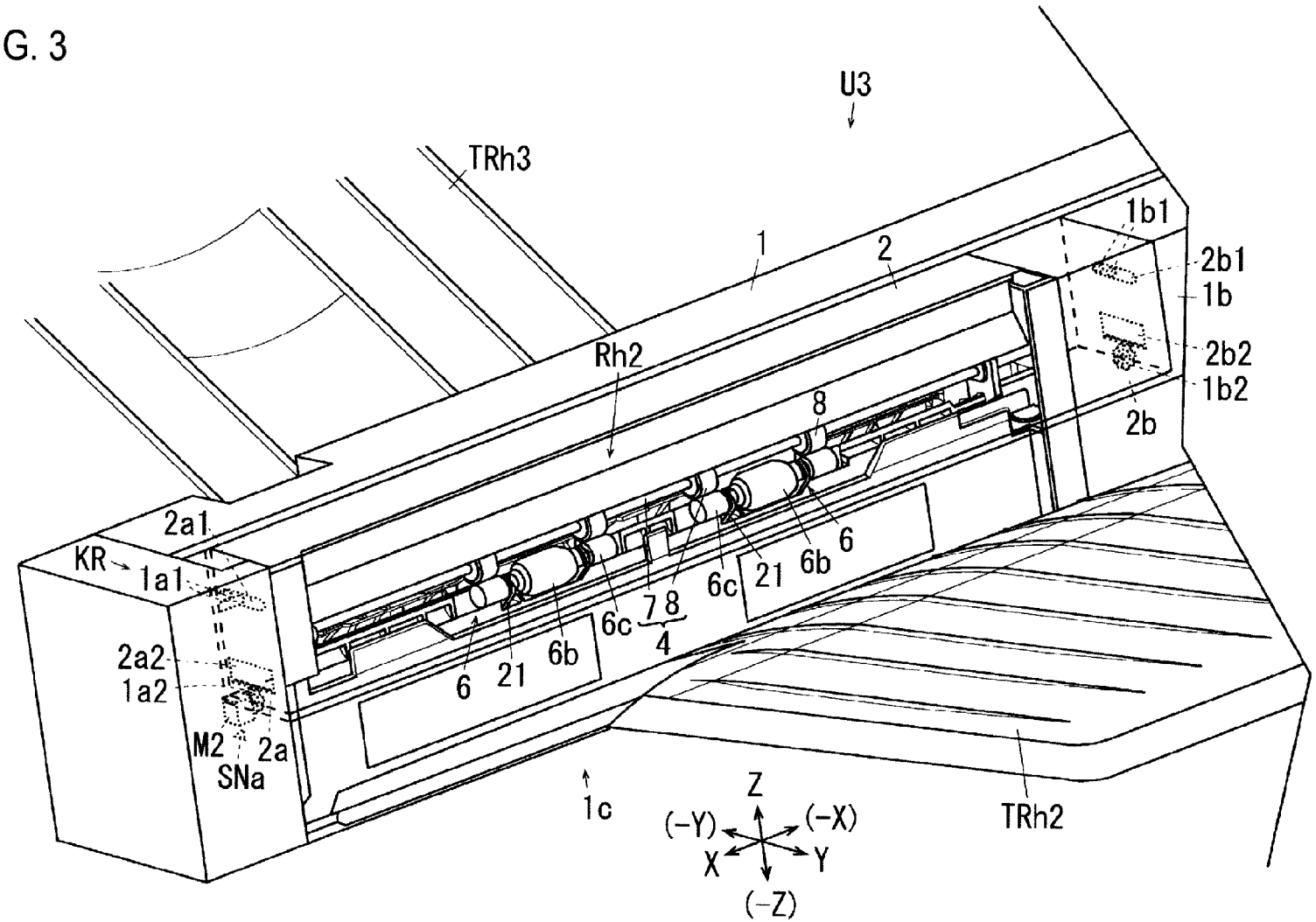
FIG. 3 is a perspective diagram of an option discharge unit that is an example of the medium discharging device of Example 1.

FIG. 3 is a perspective diagram of the option discharge unit U3 which is an example of the medium discharging device of Example 1.

Figure 4A:
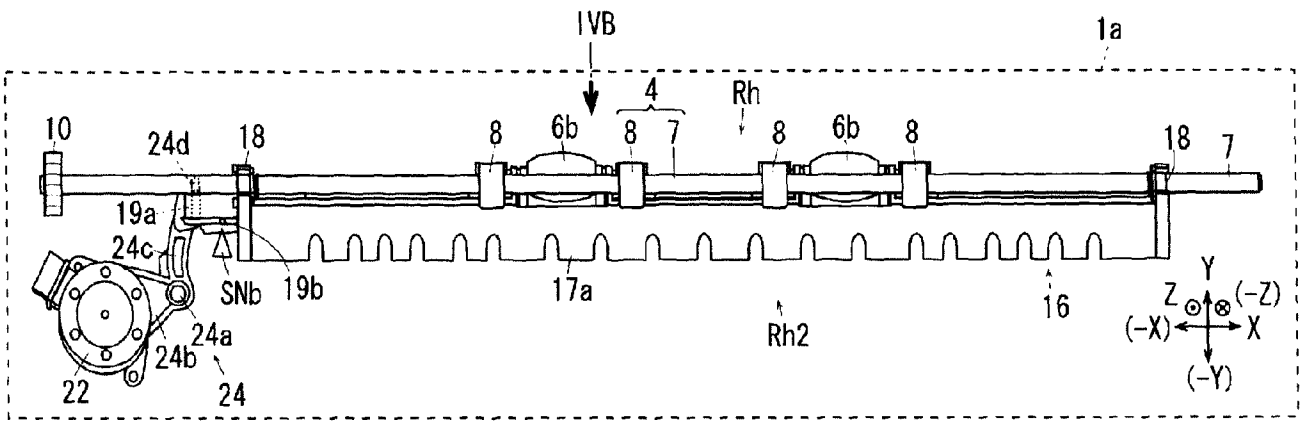
FIGS. 4A and 4B are diagrams of an offset mechanism of the medium discharging device of Example 1.
Figure 4B:
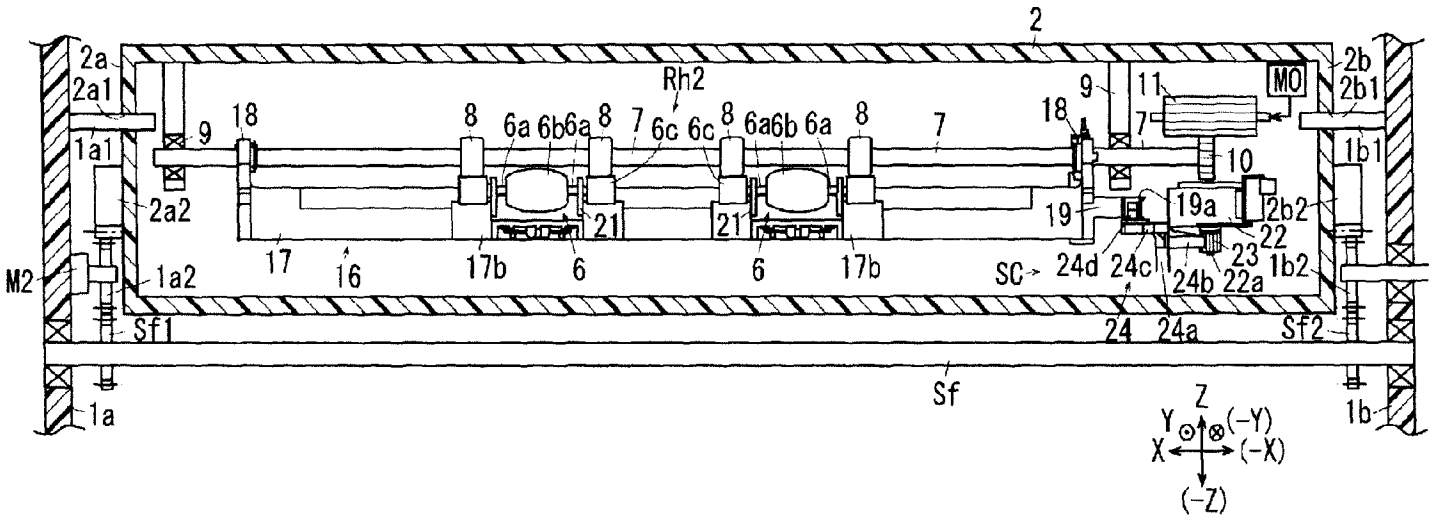

FIG. 4A is a diagram of an offset mechanism of the medium discharging device of Example 1, as seen from the upper side, and FIG. 4B is a diagram of the offset mechanism, as seen from the direction of the arrow IVB in FIG. 4A.

Referring to FIGS. 2 and 4, the option discharge unit U3 in Example 1 has a discharging apparatus body 1. The discharging apparatus body 1 in Example 1 has a body front wall 1*a* which is placed in a right end portion of the front side, a body rear wall 1*b* which is placed in a right end portion of the rear side, and a supporting member housing space 1*c* which is formed between the body front wall 1*a* and the body rear wall 1*b*.

Referring to FIGS. 3 and 4B, a plurality of front pins 1*a*1 which are examples of a front guided supporting portion that extends rearward are supported by an upper portion of the body front wall 1*a* in Example 1. Furthermore, a medium conveyance direction moving motor M2 which is an example of a medium conveyance direction driving source is supported by a lower portion of the body front wall 1*a*. A front pinion gear 1*a*2 which is an example of a front disk gear is supported by a rear end portion of the rotation shaft of the medium conveyance direction moving motor M2.

In a similar manner as the front pins 1*a*1 of the body front wall 1*a*, a plurality of rear pins 1*b*1 which are examples of a rear guided supporting portion that extends forward are supported by the body rear wall 1*b* in Example 1. A rear pinion gear 1*b*2 which is an example of a rear disk gear is rotatably supported by a lower portion of the body rear wall 1*b*. A shaft Sf which is an example of a drive transmission member that extends in the anteroposterior direction is rotatably supported below the pinion gears 1*a*2, 1*b*2. Drive transmission gears Sf1, Sf2 which are examples of drive transmission gears meshing with the pinion gears 1*a*2, 1*b*2 are supported by the both ends of the shaft Sf in the anteroposterior direction.

Referring to FIGS. 3, 4A, and 4B, a medium discharge member supporting body 2 is housed in the supporting member housing space 1*c* in Example 1. A front guide slot 2*a*1 which laterally extends is formed in an upper portion of a front end wall 2*a* of the medium discharge member supporting body 2. The front pins 1*a*1 is passed through and supported by the front guide slot 2*a*1. A front rack gear 2*a*2 which is an example of a planar front flat gear that laterally extends is supported by a middle portion of the front end wall 2*a*. The front rack gear 2*a*2 meshes with the front pinion gear 1*a*2 which is placed on the lower side.

Also, a rear end wall 2*b* of the medium discharge member supporting body 2 has a rear guide slot 2*b*1 and rear rack gear 2*b*2 which are similar to the front guide slot 2*a*1 and the front rack gear 2*a*2 of the front end wall 2*a*. The rear pins 1*b*1 are passed through and supported by the rear guide slot 2*b*1. The rear rack gear 2*b*2 meshes with the rear pinion gear 1*b*2 which is placed on the lower side.

Therefore, the medium discharge member supporting body 2 in Example 1 is supported in the state where the pins 1*a*1, 1*b*1 of the discharging apparatus body 1 are passed through the guide slots 2*a*1, 2*b*1. The medium discharge member supporting body 2 is slidingly movable in the lateral direction via the gears 1*a*2, 2*a*2, 1*b*2, 2*b*2, Sf1, Sf2 by forward/reverse rotation of the medium conveyance direction moving motor M2. Namely, the medium discharge member supporting body 2 in Example 1 is movable between (i) a right advanced position at the downstream end in the medium conveyance direction indicated by the broken line in FIG. 2 and (ii) a left retracted position which is upstream of the advanced position in the medium conveyance direction and which is indicated by the solid line in FIG. 2. Also, the medium discharge member supporting body 2 is configured to be retractable between the retracted position indicated by the solid line and the advanced position indicated by the broken line. When the medium discharge member supporting body 2 is located in the advanced position, a space is defined between the medium discharge member supporting body 2 and the tray TRH2 and below the medium discharge member supporting body 2.

Referring to FIG. 3, a retracted position detection sensor SNa which is an example of a retracted position detecting member for detecting that the medium discharge member supporting body 2 is moved to the retracted position is placed below the supporting member housing space 1*c*.

The pins 1*a*1, 1*b*1, the guide slots 2*a*1, 2*b*1, the gears 1*a*2, 2*a*2, 1*b*2, 2*b*2, Sf1, Sf2, the medium conveyance direction moving motor M2, and the like constitute a rear-end separating mechanism KR which is an example of a separation member in Example 1.

Referring to FIGS. 2 to 4B, the inversion roll Rh2 in Example 1 is supported by medium discharge member supporting portions 2*c*, 2*c* of the medium discharge member supporting body 2. The inversion roll Rh2 has: a driving discharge roll 4 which is an example of a driving side discharge member that is placed in the upper side in the gravitational direction; and driven discharge rolls 6 which are examples of a driven side discharge member that is opposed to the driving discharge roll 4, and that is drivenly rotated in accordance with rotation of the driving discharge roll 4. Referring to FIGS. 4A and 4B, the driving discharge roll 4 has a driving shaft 7 which is an example of a rotation shaft that extends in the anteroposterior direction, and four driving roll bodies 8 which are examples of a driving side rotation member that is fixed and supported by the driving shaft 7. Referring to FIG. 4B, the driving shaft 7 is supported at the both ends by bearing portions 9 supported by the medium discharge member supporting portions 2*c*, 2*c*, in a state where the driving shaft 7 is rotatable and movable in the axial direction. A driven gear 10 which is an example of a driven gear is supported by the rear end of the driving shaft 7. A transmission gear 11 which is an example of a transmission gear meshes with the driven gear 10 so that a driving force of a discharging motor M0 which is an example of a driving source is transmitted to the transmission gear 11. The axial length of the transmission gear 11 in Example 1 is longer than that of the driven gear 10. The axial length of the transmission gear 11 is set to such a length that even when the driving shaft 7 is axially moved in the sliding movable range, the transmission gear 11 can continue to mesh with the driven gear 10 that slides together with the move of the driving shaft 7 and can transmit the driving source.

A driven roll supporting frame 16 which is an example of a driven side discharge member frame and which extends in the anteroposterior direction is placed below the driving shaft 7. The driven roll supporting frame 16 has a driven side frame body 17 which extends in the anteroposterior direction, and coupling arms 18 which are example of coupling portions that are supported by front and rear end portions of the driven side frame body 17 and that are supported inside the bearing portions 9 of the driving shaft 7. Therefore, the driven roll supporting frame 16 is integrally moved in the anteroposterior direction in accordance with anteroposterior movement of the driving shaft 7.

An offset coupling portion 19 which is an example of a shift coupling portion that extends rearward is formed in the rear end of the driven side frame body 17. A slot-like coupling hole 19*a* which is an example of a non-coupling portion and which laterally extends as shown in FIG. 4A is formed in the rear end of the offset coupling portion 19.

Referring to FIG. 4A, a face-down discharge guide 17*a* which is an example of a movement guiding portion that leftward elongates and that guides the recording sheet S conveyed through the face-down discharging path SH6 to the inversion roll Rh2 is formed in the driven side frame body 17.

A pair of front and rear driven roll supporting portions 17*b* are formed in a middle portion of the driven side frame body 17 in the anteroposterior direction, so as to correspond to the positions of the driving roll bodies 8. The driven roll supporting portions 17*b* support a pair of front and rear driven roll supporting members 21 which rotatably support corresponding one of the driven discharge rolls 6 and which urge the driven discharge roll 6 toward the driving discharge roll 4. Each of the driven roll supporting members 21 is configured by a plate-spring like member. A plate-spring like member is described in, for example, JP 2006-21843A. Therefore, detailed description thereon will be omitted. The driven roll supporting members 21 are not limited to a plate-spring like member, and may employ one of various conventionally known configurations.

Each of the driven discharge rolls 6 has a driven shaft portion 6*a* which is rotatably supported by the pair of front and rear driven roll supporting members 21. A barrel-shaped corrugation roll 6*b* which is an example of a curvature applying member for applying curvature to enhance the straight advancing property of the recording sheet S discharged to the face-down tray TRh2 is supported by a middle portion of the driven shaft portion 6*a* in the anteroposterior direction. Four driven roll bodies 6*c* which are examples of a driven side rotation member that is opposed to the driving roll bodies 8 are supported by front and rear end portions of the driven shaft portions 6*a*. Normally, the driven roll bodies 6*c* are held by the plate-spring like driven roll supporting members 21, in a state where the driven roll bodies 6*c* are in contact with the driving roll bodies 8.

Referring to FIGS. 4A and 4B, an offset motor 22 which is an example of a medium shift driving source that is fixed and supported by the medium discharge member supporting body 2 is supported in rear of the offset coupling portion 19. The offset motor 22 has an offset motor shaft 22*a* which extends downward. A motor gear 23 is supported by the motor shaft 22*a*.

A sector gear 24 which is an example of a medium shift drive transmission member is placed between the offset motor 22 and the offset coupling portion 19. The sector gear 24 is rotatably supported by the apparatus body 1 while centered at the rotation center 24*a*. A sector-shaped gear portion 24*b* which is an example of a gear portion is formed on the offset motor side of the rotation center 24*a*. The sector gear 24 has a coupling arm 24*c* which extends from the rotation center 24*a* toward the offset coupling portion 19. Referring to FIG. 4B, a coupling projection 24*d* which is an example of a coupling portion that is fitted into the coupling hole 19*a* is supported by the tip end of the coupling arm 24*c*.

When the offset motor 22 is rotated forwardly or reversely, therefore, the sector gear 24 swings about the rotation center 24*a*, and the coupling projection 24*d* moves in the form of an arcuate shape which is centered at the rotation center 24*a* and which contains anteroposterior components. At this time, the rotation is transmitted by the coupling hole 19*a* into which the coupling projection 24*d* is fitted, and the driving shaft 7, the driven roll supporting frame 16 which is supported by the driving shaft 7, and the like are moved in the anteroposterior direction. When the offset motor 22 is rotated forwardly or reversely, therefore, the driving discharge roll 4 and the driven discharge rolls 6 are integrally moved in the anteroposterior direction. Referring to FIG. 4A, the rotation of the offset motor 22 is controlled between (i) a reference position that is set by an operation in which a home position sensor SNb which is an example of a reference position detecting member detects a detected portion 19*b* of the offset coupling portion 19 and (ii) a shifted position that is axially shifted from the preset reference position based on the rotation amount.

An offset discharging mechanism SC which is an example of a adjustment member in Example 1 and which is an example of a shift discharging mechanism is configured by the members denoted by the reference numerals 7 to 24, and the like.

Namely, the inversion roll Rh2 in Example 1 is supported by the rear-end separating mechanism KR so as to be movable in the lateral direction which is the medium conveyance direction, and supported by the offset discharging mechanism SC so as to be movable the anteroposterior direction which is the medium width direction.

Although description will be omitted for the sake of simplicity, the discharge roller Rh and the face-up discharge roll Rh3 in Example 1 are supported so as to be movable in the lateral and anteroposterior directions, by a rear-end separating mechanism KR and an offset discharging mechanism SC which are similar to those of the inversion roll Rh2.

The rear-end separating mechanism KR, the offset discharging mechanism SC, and the like constitute a moving mechanism (KR+SC) in Example 1.

The conveyance paths SH1 to SH8 constitute a conveyance path SH in Example 1, and the conveyance path SH, the sheet feeding device (Rp+Rs), the conveyance rolls Ra, the registration roll Rr, the discharge roller Rh, the inversion roll Rh2, the face-up discharge roll Rh3, the inverting-path discharge roll Ra2, the gates GT1 to GT3, an offset driving portion 101, a second drive transmission member 114, and the like constitute a medium conveyance device YHS in Example 1.

(Description of Controller in Example 1)

Figure 5:
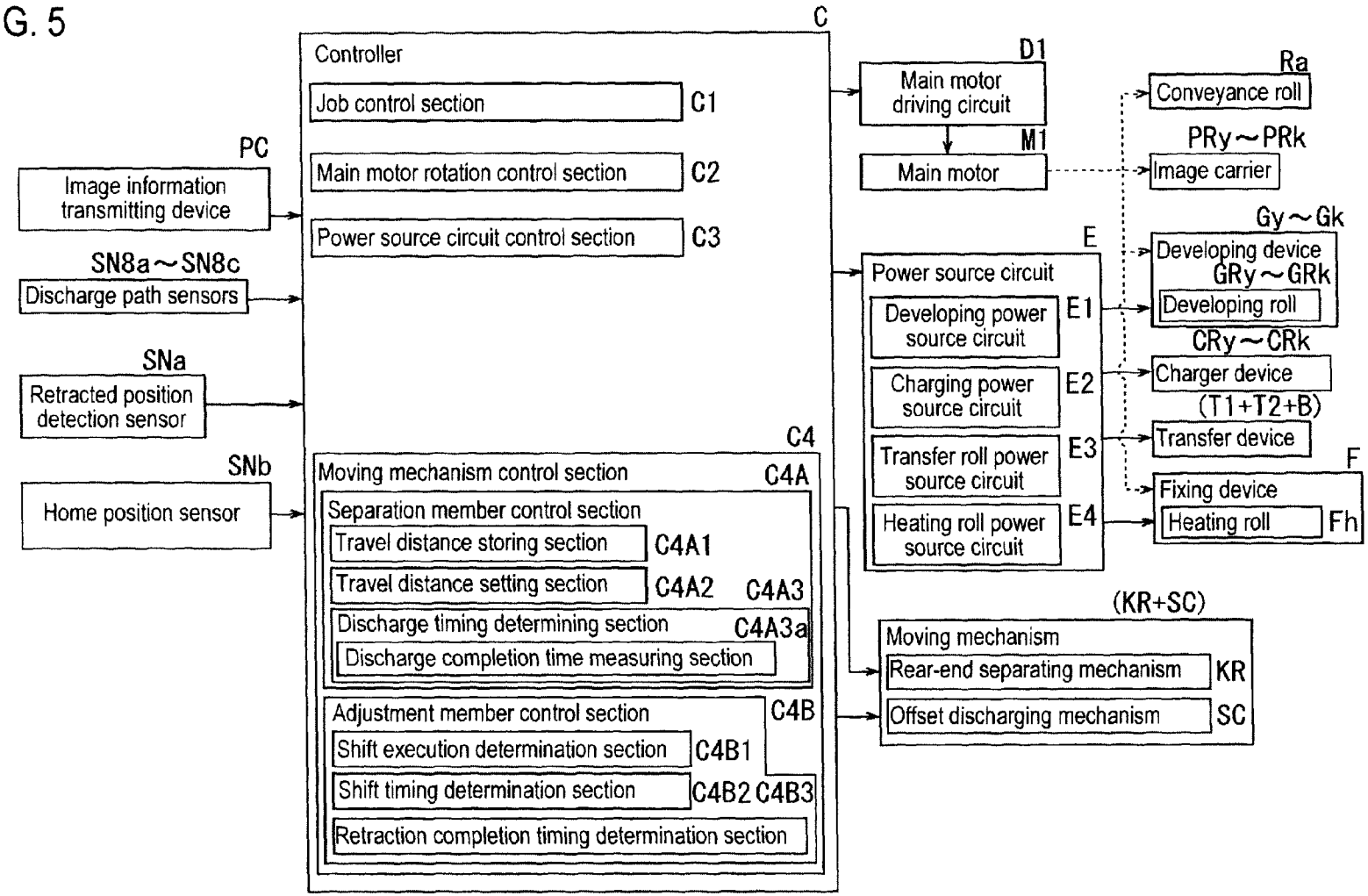
FIG. 5 is a block diagram showing functions of a controller in the image forming apparatus of Example 1.

FIG. 5 is a block diagram showing functions of the controller in the image forming apparatus of Example 1 of the invention.

Referring to FIG. 5, the controller C is configured by a computer which is an example of a computer having: an input/output interface, or a so-called I/O that is an example of an input/output signal adjusting portion through which signals are input from and output to the outside, and which adjusts levels of input/output signals; a read-only memory, or a so-called ROM which stores programs and data for performing necessary processes; a random access memory, or a so-called RAM which temporarily stores required data; a central processing unit, or a so-called CPU which performs processes according to the programs stored in the ROM; a clock oscillator; and the like. When the programs stored in the ROM are executed, it is possible to realize various functions.

(Signal Output Elements Connected to Controller C)

Output signals of the following signal output elements PC, SN8*a* to SN8*c*, SNa, SNb, and the like are supplied to the controller C.

PC: Image Information Transmitting Device

The image information transmitting device PC transmits image information as an output signal to the controller C.

SN8*a* to SN8*c*: Discharge Path Sensors

The discharge path sensors SN8*a* to SN8*c* detect presence or absence of the recording sheet S conveyed to the sheet discharging paths SH3, SH6, SH7, and supply detection signals to the controller C.

SNa: Retracted Position Detection Sensor

The retracted position detection sensor SNa detects presence or absence of the medium discharge member supporting body 2, and supplies a detection signal to the controller C.

SNb: Home Position Sensor

The home position sensor SNb detects presence or absence of the detected portion 19*b* of the offset coupling portion 19, and supplies a detection signal to the controller C.

(Controlled Elements Connected to Controller C)

The controller C outputs control signals for the following controlled elements D1, E.

D1: Main Motor Driving Circuit

A main motor driving circuit D1 which is an example of a main driving source driving circuit drives the main motor M1 which is an example of a main driving source, so as to rotate the image carriers PRy to PRk, the developing rolls GRy to GRk of the developing devices Gy to Gk, the heating roll Fh of the fixing device F, the conveyance rolls Ra, and the like via gears which are examples of a driving force transmitting member.

E: Power Source Circuit

The power source circuit E has a developing power source circuit E1, a charging power source circuit E2, a transfer roll power source circuit E3, and a heating roll power source circuit E4.

E1: Developing Power Source Circuit

The developing power source circuit E1 applies a developing voltage to the developing rolls GRy to GRk of the developing devices Gy to Gk.

E2: Charging Power Source Circuit

The charging power source circuit E2 applies a charge voltage to the charger devices CRy to CRk.

E3: Transfer Roll Power Source Circuit

The transfer roll power source circuit E3 applies a transfer voltage to the primary transfer devices T1*y* to T1*k* and the secondary transfer roll T2*b* of the transfer device (T1+T2+B).

E4: Heating Roll Power Source Circuit

The heating roll power source circuit E4 applies a heating electric power to a heater which is an example of a heating member of the heating roll Fh of the fixing device F.

(Functions of Controller C)

The controller C has the following function realizing sections by means of programs for controlling operations of the controlled elements D1, E in accordance with output signals of the signal output elements PC, SNa, SNb, etc.

C1: Job Control Section

A job control section C1 which is an example of an image forming operation control section controls the operations of the latent-image forming devices LHy, LHm, LHc, LHk, the charger devices CRy to CRk, the image recording device (Uy to Uk+BM+T2+F), the medium conveyance device YHS, and the like, in accordance with transmission of image information by the image information transmitting device PC, to thereby execute a job which is an example of an image forming operation.

C2: Main Motor Rotation Control Section

A main motor rotation control section C2 which is an example of a main driving source control section controls rotation of the main motor M1 which is an example of the main driving source, via the main motor driving circuit D1 which is an example of the main driving source driving circuit, to thereby control rotation driving of the image carriers PRy to PRk, the developing rolls GRy to GRk of the developing devices Gy to Gk, the heating roll Fh of the fixing device F, the conveyance rolls Ra, and the like.

C3: Power Source Circuit Control Section

A power source circuit control section C3 controls the operation of the power source circuit E to control voltage and current supplied to the developing rolls GRy to GRk, the charger devices CRy to CRk, the primary transfer devices T1*y* to T1*k*, the secondary transfer roll T2*b*, the heater of the heating roll Fh, etc.

C4: Moving Mechanism Control Section

A moving mechanism control section C4 has a separation member control section C4A and a adjustment member control section C4B, and controls the moving mechanism (KR+SC).

C4A: Separation Member Control Section

The separation member control section C4A has a travel distance storing section C4A1, a travel distance setting section C4A2, and a discharge timing determination section C4A3, and controls the rear-end separating mechanism KR.

C4A1: Travel Distance Storing Section

The travel distance storing section C4A1 stores a travel distance between the advanced position and the retracted position. The travel distance is set in advance for each sheet size that is an example of a medium type of the recording sheet S. In the travel distance storing section C4A1 in Example 1, as the sheet size of the recording sheet S is larger, the travel distance is preset so as to be longer.

C4A2: Travel Distance Setting Section

The travel distance setting section C4A2 sets the travel distance stored in the travel distance storing section C4A1, based on a sheet size of the image information transmitted from the image information transmitting apparatus PC.

C4A3: Discharge Timing Determination Section

The discharge timing determination section C4A3 has a discharge completion time measuring section C4A3*a* which measures a preset discharge completion time T1. The discharge timing determination section C4A3 determines as to whether or not a discharge timing comes at which the recording sheet S is discharged from the discharge rolls Rh to Rh3. The discharge timing determination section C4A3 in Example 1 determines as to whether or not the discharge completion time T1 has elapsed after the rear end of the recording sheet S in the medium conveyance direction is detected by the discharge path sensor SN8*a*, SN8*b*, or SN8*c*, i.e., the state of the discharge path sensor SN8*a*, SN8*b*, or SN8*c* is changed from the ON state to the OFF state, to thereby determine as to whether or not the discharge timing comes.

Based on the travel distance which is set by the travel distance setting section C4A2, therefore, the separation member control section C4A in Example 1 controls the rear-end separating mechanism KR so as to move the medium discharge member supporting body 2, which supports the discharge roll Rh, Rh2, or Rh3, from the retracted position to the advanced position. If the discharge timing determination section C4A3 determines that the discharge timing comes, the separation member control section C4A controls the rear-end separating mechanism KR so as to move the medium discharge member supporting body 2 in the sequence of the advanced position, the retracted position, and the advanced position, based on the signal of the retracted position detection sensor SNa indicating that the recording sheet S is detected.

C4B: Adjustment Member Control Section

The adjustment member control section C4B has a shift execution determination section C4B1, a shift timing determination section C4B2, and a retraction completion timing determination section C4B3, and controls the offset discharging mechanism SC.

C4B1: Shift Execution Determination Section

The shift execution determination section C4B1 determines as to whether or not an offsetting operation is to be performed for the discharged recording sheet S, based on the numbers of copies and pages of the image information transmitted from the image information transmitting device PC.

C4B2: Shift Timing Determination Section

The shift timing determination section C4B2 determines as to whether or not a shift timing at which the offsetting operation is performed comes. If the rear end of the recording sheet S in the medium conveyance direction is detected by the discharge path sensor SN8*a*, SN8*b*, or SN8*c*, the shift timing determination section C4B2 in Example 1 determines that the shift timing at which only the discharge roll Rh, Rh2, or Rh3 clamp and discharges the recording sheet S comes.

C4B3: Retraction Completion Timing Determination Section

Based on the retracted position detection sensor SNa, the retraction completion timing determination section C4B3 determines as to whether or not a retraction completion timing at which the medium discharge member supporting body 2 is moved from the advanced position to the retracted position comes.

If the shift execution determination section C4B1 determines that the offsetting operation is to be performed and the shift timing determination section C4B2 determines that the shift timing comes, therefore, the adjustment member control section C4B in Example 1 causes the driving discharge roll 4 and the driven discharge roll 6 to be moved from the reference position to the shifted position. If the retraction completion timing determination section C4B3 determines that the retraction completion timing comes, the adjustment member control section C4B causes the driving discharge roll 4 and the driven discharge roll 6 to be moved from the shifted position to the reference position, based on the signal of the home position sensor SNb indicating that the detected portion 19*b* of the offset coupling portion 19 is detected.

(Description of Flowchart of Example 1)

Next, the flow of the process of the printer U of Example 1 of the invention will be described with reference to the flowcharts.

(Description of Flowchart of Separation Member Controlling Process in Example 1)

Figure 6:
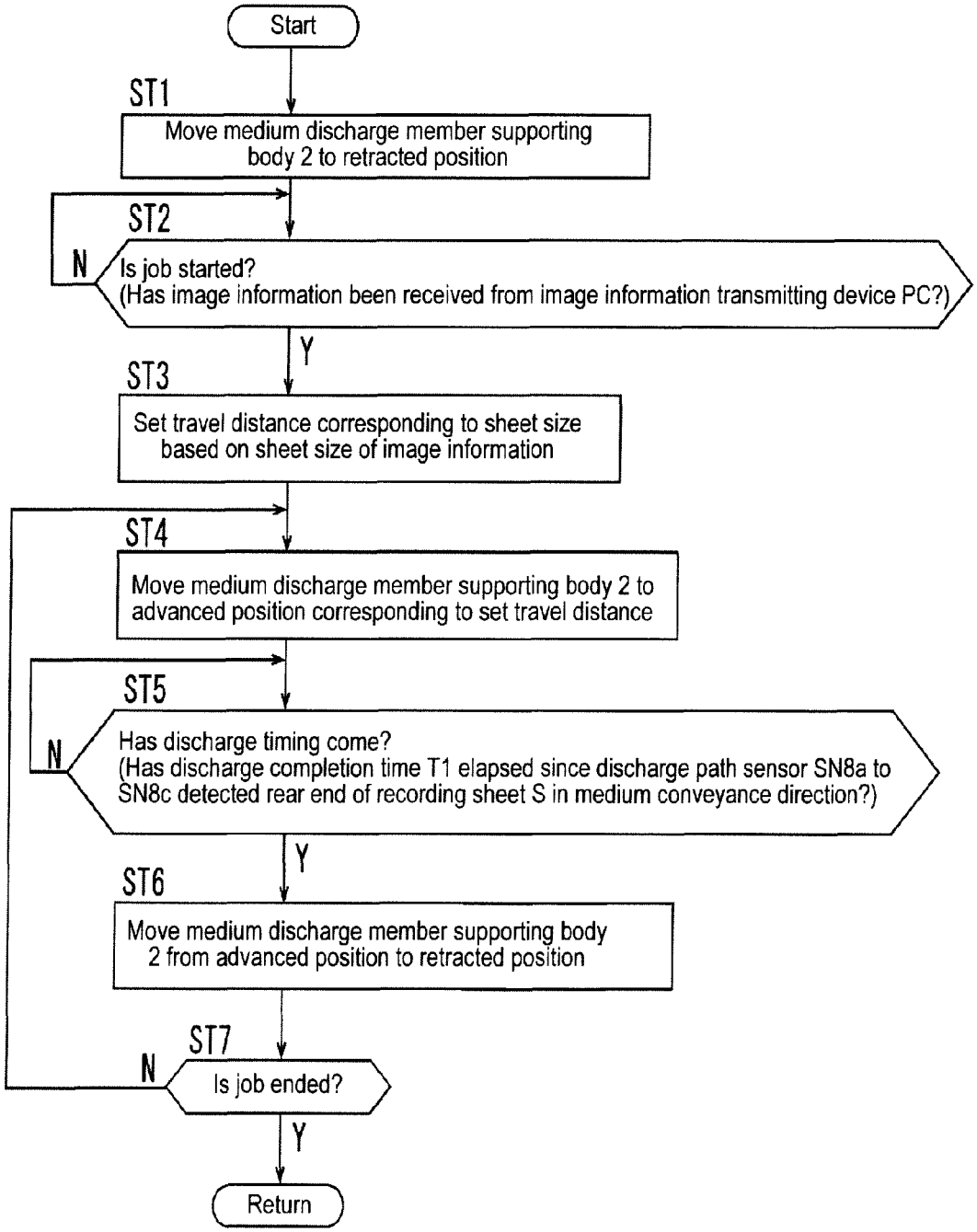
FIG. 6 is a flowchart of a separation member controlling process in Example 1.

FIG. 6 is a flowchart of a separation member controlling process in Example 1 of the invention.

The process of each step ST in the flowchart of FIG. 6 is performed in accordance with the programs stored in the controller C of the printer U. The process is performed in a parallel process with other various processes of the printer U.

The flowchart shown in FIG. 6 is started by turning on a power source of the printer U.

In ST1 of FIG. 6, the medium discharge member supporting body 2 is moved to the retracted position via the gears 1*a*2, 2*a*2, 1*b*2, 2*b*2, Sf1, Sf2, the pins 1*a*1, 1*b*1, and the guide slots 2*a*1, 2*b*1 by forward/reverse rotation of the medium conveyance direction moving motor M2. Then, the process proceeds to ST2.

In ST2, it is determined as to whether or not image information is received from the image information transmitting device PC, to thereby determine as to whether or not a job is started. If yes (Y), the process proceeds to ST3, and, if no (N), ST2 is repeated.

In ST3, a travel distance corresponding a sheet size is set based on the sheet size of the received image information. Then, the process proceeds to ST4.

In ST4, the medium discharge member supporting body 2 is moved from the retracted position to the advanced position corresponding to the set travel distance, via the gears 1*a*2, 2*a*2, 1*b*2, 2*b*2, Sf1, Sf2, the pins 1*a*1, 1*b*1, and the guide slots 2*a*1, 2*b*1 by forward rotation of the medium conveyance direction moving motor M2. Then, the process proceeds to ST5.

In ST5, it is determined as to whether or not a discharge timing at which the recording sheet S is discharged from the discharge roll Rh, Rh2, or Rh3 comes. Namely, it is determined as to whether or not the discharge completion time T1 has elapsed after the rear end of the recording sheet S in the medium conveyance direction is detected by the discharge path sensor SN8*a*, SN8*b*, or SN8*c*. If yes (Y), the process proceeds to ST6, and, if no (N), ST5 is repeated.

In ST6, the medium discharge member supporting body 2 is moved from the advanced position to the retracted position via the gears 1*a*2, 2*a*2, 1*b*2, 2*b*2, Sf1, Sf2, the pins 1*a*1, 1*b*1, and the guide slots 2*a*1, 2*b*1 by reverse rotation of the medium conveyance direction moving motor M2. Then, the process proceeds to ST7.

In ST7, it is checked as to whether the job is ended. If no (N), the process returns to ST4, and, if yes (Y), the process returns to ST1.

(Description of Flowchart of Adjustment Member Control of Example 1)

Figure 7:
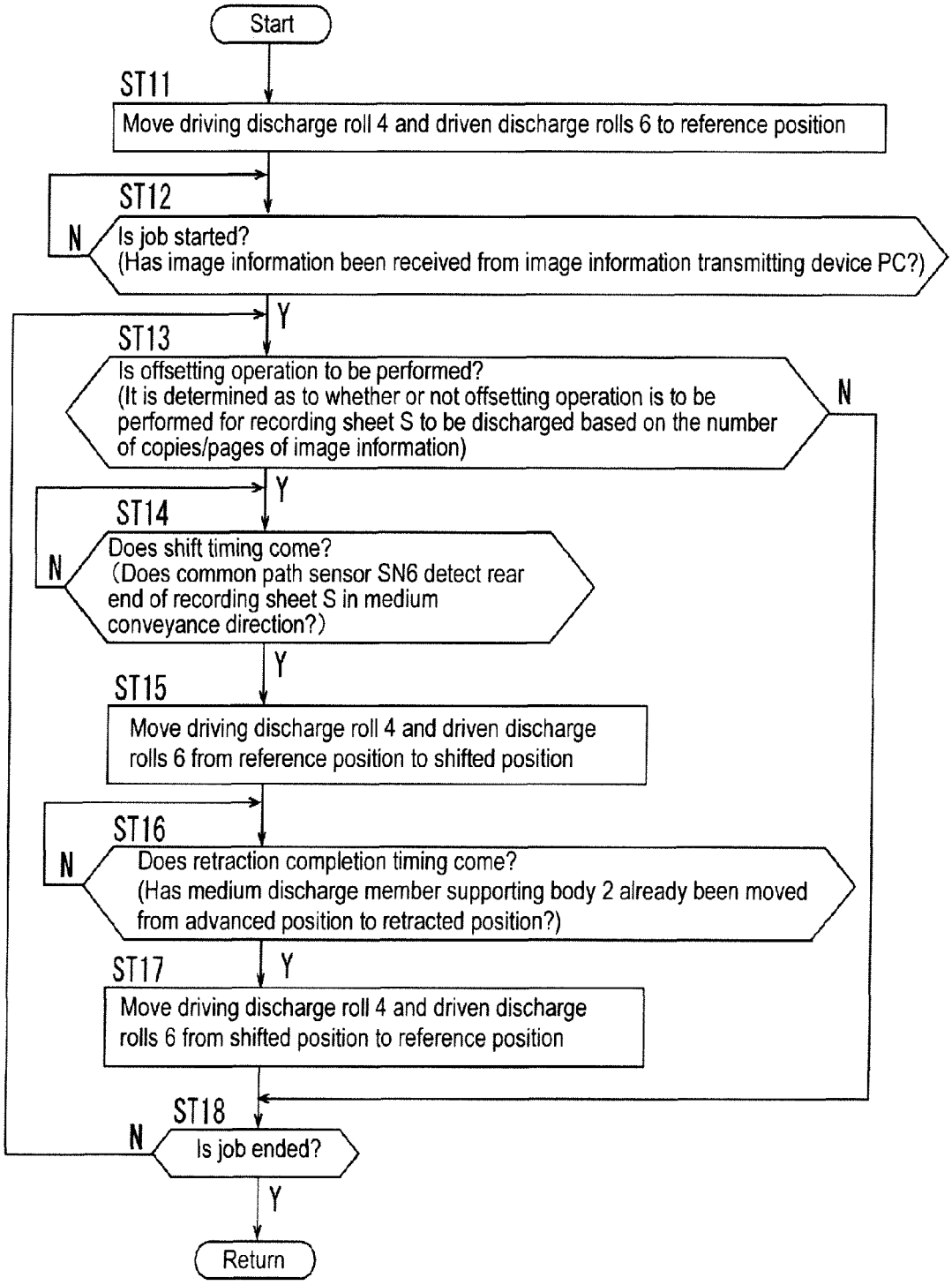
FIG. 7 is a flowchart of a adjustment member control in Example 1.

FIG. 7 is a flowchart of a adjustment member control in Example 1 of the invention.

The process of each step ST in the flowchart of FIG. 7 is performed in accordance with the programs stored in the controller C of the printer U. The process is performed in a parallel process with other various processes of the printer U.

The flowchart shown in FIG. 7 is started by turning on the power source of the printer U.

In ST11 of FIG. 7, the driving discharge roll 4 and the driven discharge rolls 6 are moved to the reference position via the gears 23, 24, the respective portions 17 to 19 of the driven roll supporting frame 16, and the like by forward/reverse rotation of the offset motor 22. Then, the process proceeds to ST12.

In ST12, it is determined as to whether or not image information is received from the image information transmitting device PC, to thereby determine as to whether the job is started. If yes (Y), the process proceeds to ST13, and, if no (N), ST12 is repeated.

In ST13, based on the numbers of copies and pages of the received image information, it is determined as to whether or not the offsetting operation is to be performed for the recording sheet S to be discharged. If yes (Y), the process proceeds to ST14, and, if no (N), the process transfers to ST18.

In ST14, it is determined as to whether or not a shift timing at which the offsetting operation is performed comes. Namely, it is determined as to whether or not the rear end of the recording sheet S in the medium conveyance direction is detected by the discharge path sensor SN8*a*, SN8*b*, or SN8*c*, to thereby determine as to whether a timing at which only the discharge roll Rh, Rh2, or Rh3 clamps and discharges the recording sheet S comes. If yes (Y), the process proceeds to ST15, and, if no (N), ST14 is repeated.

In ST15, the driving discharge roll 4 and the driven discharge rolls 6 are moved from the reference position to the shifted position via the gears 23, 24, the portions 17 to 19 of the driven roll supporting frame 16, and the like by forward rotation of the offset motor 22. Then, the process proceeds to ST16.

In ST16, based on the retracted position detection sensor SNa, it is determined as to whether or not the retraction completion timing at which the medium discharge member supporting body 2 is moved from the advanced position to the retracted position comes. If yes (Y), the process proceeds to ST17, and, if no (N), ST16 is repeated.

In ST17, the driving discharge roll 4 and the driven discharge rolls 6 are moved from the shifted position to the reference position via the gears 23, 24, the portions 17 to 19 of the driven roll supporting frame 16, and the like by reverse rotation of the offset motor 22. Then, the process proceeds to ST18.

In ST18, it is checked whether or not the job is ended. If no (N), the process returns to ST13, and, if yes (Y), the process returns to ST11.

(Operation of Example 1)

Figure 8A:
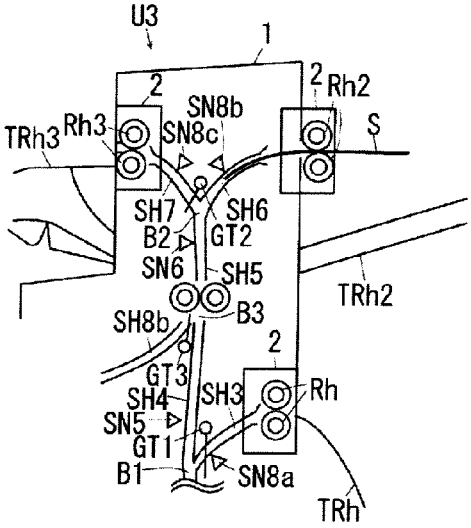
FIGS. 8A to 8D are diagrams illustrating operations in Example 1.
Figure 8B:
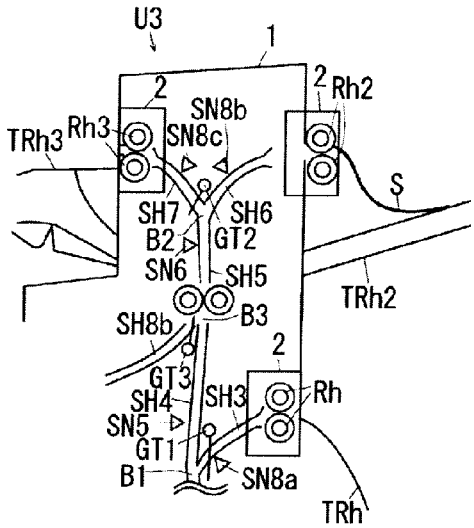
Figure 8C:
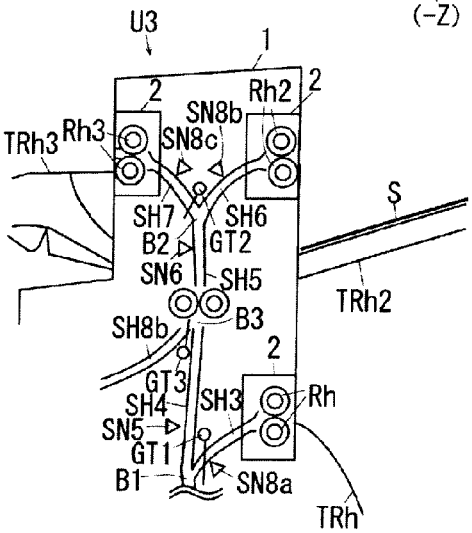
Figure 8C:
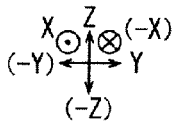
Figure 8D:
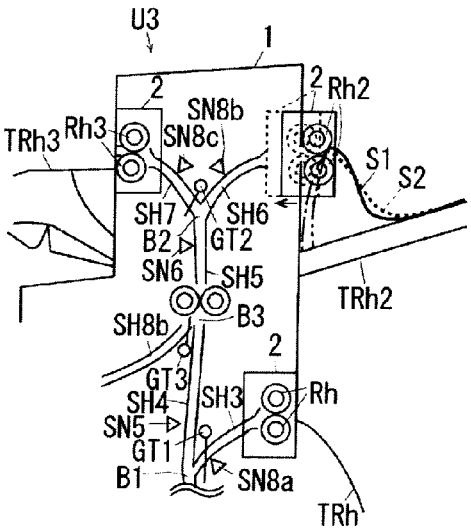

FIGS. 8A to 8D are diagrams illustrating the function of Example 1. FIG. 8A is a diagram of a state where the rear end, in the medium conveyance direction, of the recording sheet which is discharged by the inversion roll is detected by the discharge path sensor. FIG. 8B is a diagram showing a state following the state of FIG. 8A where the rear end, in the medium conveyance direction, of the recording sheet which is discharged by the inversion roll remains on the inversion roll. FIG. 8C is a diagram showing a state following the state of FIG. 8B where the inversion roll is moved from the advanced position to the retracted position, and the recording sheet is dropped. FIG. 8D is a diagram showing a state where the rear end, in the medium conveyance direction, of a recording sheet which is larger in sheet size than that of FIGS. 8A to 8C remains on the inversion roll.

In the state of FIG. 8B where the inversion roll is moved from the retracted position to the advanced position, a space is formed between the medium discharge member supporting body 2 and the tray TRH2 and below medium discharge member supporting body 2. FIG. 8C shows the state following the sate of FIG. 8B where the inversion roll is moved from the advanced position to the retracted position, and the recording sheet is dropped into the space.

In the thus configured printer U of Example 1, as shown in ST1 of FIG. 6, the medium discharge member supporting body 2 before the job execution is placed at the retracted position indicated by the solid line in FIG. 2. As shown in ST2 to ST4 of FIG. 6, furthermore, when image information is received from the image information transmitting device PC and the job is started, the medium discharge member supporting body 2 corresponding to the tray TRh, TRh2, or TRh3 onto which the recording sheet is to be discharged is moved from the retracted position to the advanced position shown in FIG. 8A.

In the case where, as shown in FIG. 8A, the recording sheet S on which an image is recorded is conveyed to the face-down discharging path SH6 by the image recording device (Uy to Uk+BM+T2+F), the recording sheet S is discharged onto the face-down tray TRh2 by the inversion roll Rh2. In this case, there is a possibility that, as shown in FIG. 8B, the rear end of the recording sheet S in the medium conveyance direction is caused to remain on the driving roll bodies 8 because of some cause such as that the discharged recording sheet S is electrically charged.

In the printer U of Example 1, in the case where the discharge timing at which the recording sheet S is discharged from the discharge roll Rh, Rh2, or Rh3 comes as shown in ST5 and ST6 of FIG. 6, however, the medium discharge member supporting body 2 is moved from the advanced position to the retracted position. Even when the rear end of the recording sheet S in the medium conveyance direction is attracted to and remains on the driving roll bodies 8, therefore, the rear end is separated from the driving roll bodies 8, and then the recording sheet S is stacked on the face-down tray TRh2 as shown in FIG. 8C.

As shown in ST7, ST4, and ST5 of FIG. 6, then, the medium discharge member supporting body 2 is moved from the next retracted position to the advanced position before the discharge timing, i.e., before the subsequent recording sheet S is conveyed to the face-down discharging path SH6. Also with respect to the subsequent recording sheet S, therefore, the medium discharge member supporting body 2 is similarly moved in the sequence of the advanced position, the retracted position, and the advanced position, and the recording sheet S is stacked on the face-down tray TRh2 while the rear end of the recording sheet S in the medium conveyance direction does not remain on the driving roll bodies 8.

In the printer U of Example 1, also in the case where the recording sheet S on which an image is recorded is conveyed to the other discharging path SH3 or SH7 and discharged by the discharge roll Rh or Rh3, the medium discharge member supporting body 2 is moved in the sequence of the advanced position, the retracted position, and the advanced position in a similar manner as the case of the inversion roll Rh2 shown in FIGS. 8A to 8D, and the recording sheet S is stacked on the tray TRh or TRh3.

In the printer U of Example 1, therefore, the discharged recording sheet S is prevented from remaining on the driving roll bodies 8. As a result, a situation where the subsequent recording sheet S enters between the recording sheet S remaining on the driving roll bodies 8 and a bundle of recording sheets S stacked on the tray TRh, TRh2, or TRh3, and the pages of the bundle of stacked recording sheets S are arranged in a wrong number sequence is prevented from occurring. A further situation where the recording sheet S remaining on the driving roll bodies 8 is hit by the subsequent recording sheet S to drop in a position displaced from the normal stack position, and misalignment arises in the bundle of recording sheets S is prevented from occurring.

In the thus configured printer U of Example 1, as shown in ST11 of FIG. 7, the discharge rolls Rh, Rh2, Rh3 before the job execution are placed at the reference position. In the case where the offset discharge is set, when the job is started and the recording sheet S on which the offsetting operation is to be performed is conveyed to the sheet discharging path SH3, SH6, or SH7 as shown in ST12 to ST14 of FIG. 7 and FIG. 8A, it is determined that the timing at which the rear end of the recording sheet S in the medium conveyance direction is detected by the discharge path sensor SN8*a*, SN8*b*, or SN8*c* is the shift timing. In ST15 of FIG. 7, the driving discharge roll 4 and the driven discharge roll 6 of the discharge roll Rh, Rh2, or Rh3 are moved from the reference position to the shifted position. As a result, the recording sheet S is moved to the shifted position in the state where the recording sheet is clamped only by the discharge roll Rh, Rh2, or Rh3.

In ST16 and ST17 of FIG. 7, it is determined that the timing at which the retracted position detection sensor SNa detects that the medium discharge member supporting body 2 is moved from the advanced position to the retracted position is the retraction completion timing, and the discharge roll Rh, Rh2, or Rh3 is moved from the shifted position to the reference position. Namely, after the medium discharge member supporting body 2 is moved from the advanced position to the retracted position, the rear end of the recording sheet S in the medium conveyance direction is separated from the driving roll bodies 8, and the recording sheet S is stacked on the tray TRh, TRh2, or TRh3, the discharge roll Rh, Rh2, or Rh3 is returned from the shifted position to the reference position. As a result, the return from the shifted position to the reference position is performed in the state where the rear end of the recording sheet S in the medium conveyance direction does not remain on the driving roll bodies 8. Therefore, a situation where the stack position of the recording sheet S remaining on the driving roll bodies 8 is displaced by the movement from the shifted position to the reference position in the medium width direction, and misalignment arises in the bundle of recording sheets S is prevented from occurring.

In the thus configured printer U of Example 1, as the sheet size of the recording sheet S is larger, a situation where, as shown in FIG. 8D, the recording sheet S is supported in a bent state occurs more frequently in the case where the rear end of the recording sheet S in the medium conveyance direction remains. Namely, a first recording sheet S1 which is a recording sheet S having a larger sheet size indicated by the solid line in FIG. 8D is supported between the tray TRh, TRh2, or TRh3 and the driving roll bodies 8 in a state where the sheet is bent more largely than a second recording sheet S2 which is a recording sheet S having a smaller sheet size indicated by the broken line in FIG. 8D. Therefore, the orbit of dropping of the rear end of the first recording sheet S1 in the medium conveyance direction, indicated by the dash-dot line in FIG. 8D is more elongated leftward or toward the upstream side of the medium conveyance direction as compared with the orbit of dropping of the rear end of the second recording sheet S2 in the medium conveyance direction, indicated by the dash-dot-dot line in FIG. 8D.

In the printer U of Example 1, however, the travel distance is set in accordance with the sheet size, so that, as the sheet size is larger, the travel distance is longer, or namely the distance of retraction from the advanced position where the remaining of the rear end of the recording sheet S1 or S2 in the medium conveyance direction occurs is longer. In the case where the recording sheets S1 and S2 of the respective sheet sizes are separated and dropped from the driving roll bodies 8, therefore, a failure such as that, as indicated by the broken and dash-dot lines in FIG. 8D, the medium discharge member supporting body 2 are not sufficiently retracted and hence the sheets are caught by the medium discharge member supporting body and cannot be dropped therefrom is prevented from occurring, and the sheets are stacked on the tray TRh, TRh2, or TRh3.

Example 2

Next, Example 2 of the invention will be described. In the description of Example 2, components corresponding to those of Example 1 described above are denoted by the same reference numerals, and their detailed description is omitted.

Example 2 is different from Example 1 in the following points, but configured in a similar manner as Example 1 in the other points.

(Description of Controller in Example 2)

Figure 9:
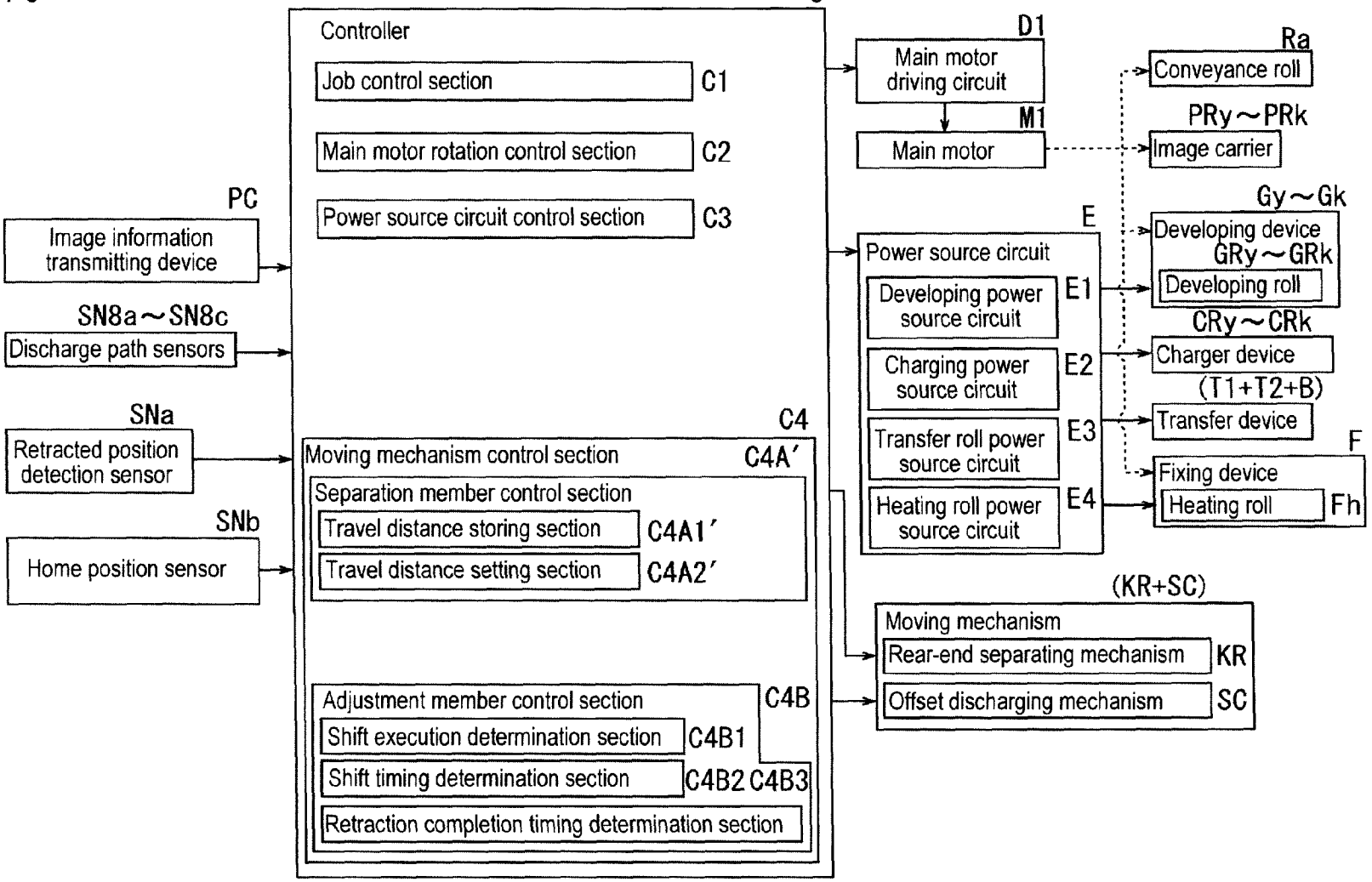
FIG. 9 is a block diagram showing functions of a controller of an image forming apparatus of Example 2, and corresponding to FIG. 5 in Example 1.

FIG. 9 is a block diagram showing functions of the controller in an image forming apparatus of Example 2 of the invention, and corresponding to FIG. 5 in Example 1.

In the controller C in Example 2, the moving mechanism control section C4 has a separation member control section C4A' in place of the separation member control section C4A. The other components of the controller C are similar to those of Example 1, and therefore their detailed description is omitted.

(Function of Controller C)

C4A': Separation Member Control Section

The separation member control section C4A' has a discharge timing determination section C4A3 which is similar to that in Example 1, and further has a travel distance storing section C4A1' and a travel distance setting section C4A2' in place of the travel distance storing section C4A1 and the travel distance setting section C4A2.

C4A1': Travel Distance Storing Section

The travel distance storing section C4A1' stores the travel distance between the advanced position and retracted position which are preset. In contrast to that the travel distance storing section C4A1 in Example 1 is set so that as the sheet size of the recording sheet S is larger, the travel distance is longer, the travel distance storing section C4A1' in Example 2 is set so that the travel distance is identical irrespective of the sheet size.

C4A2': Travel Distance Setting Section

The travel distance setting section C4A2' sets the travel distance stored in the travel distance storing section C4A1'.

Based on the travel distance which is set by the travel distance setting section C4A2', the separation member control section C4A' in Example 2 controls the rear-end separating mechanism KR so that, if the discharge timing determination section C4A3 determines that it is the discharge timing, the medium discharge member supporting body 2 is moved in the sequence of the retracted position, the advanced position, and the retracted position.

(Description of Flowchart of Example 2)

Next, the flow of the process of the printer U of Example 2 of the invention will be described with reference to the flowcharts.

(Description of Flowchart of Separation Member Controlling Process in Example 2)

Figure 10:
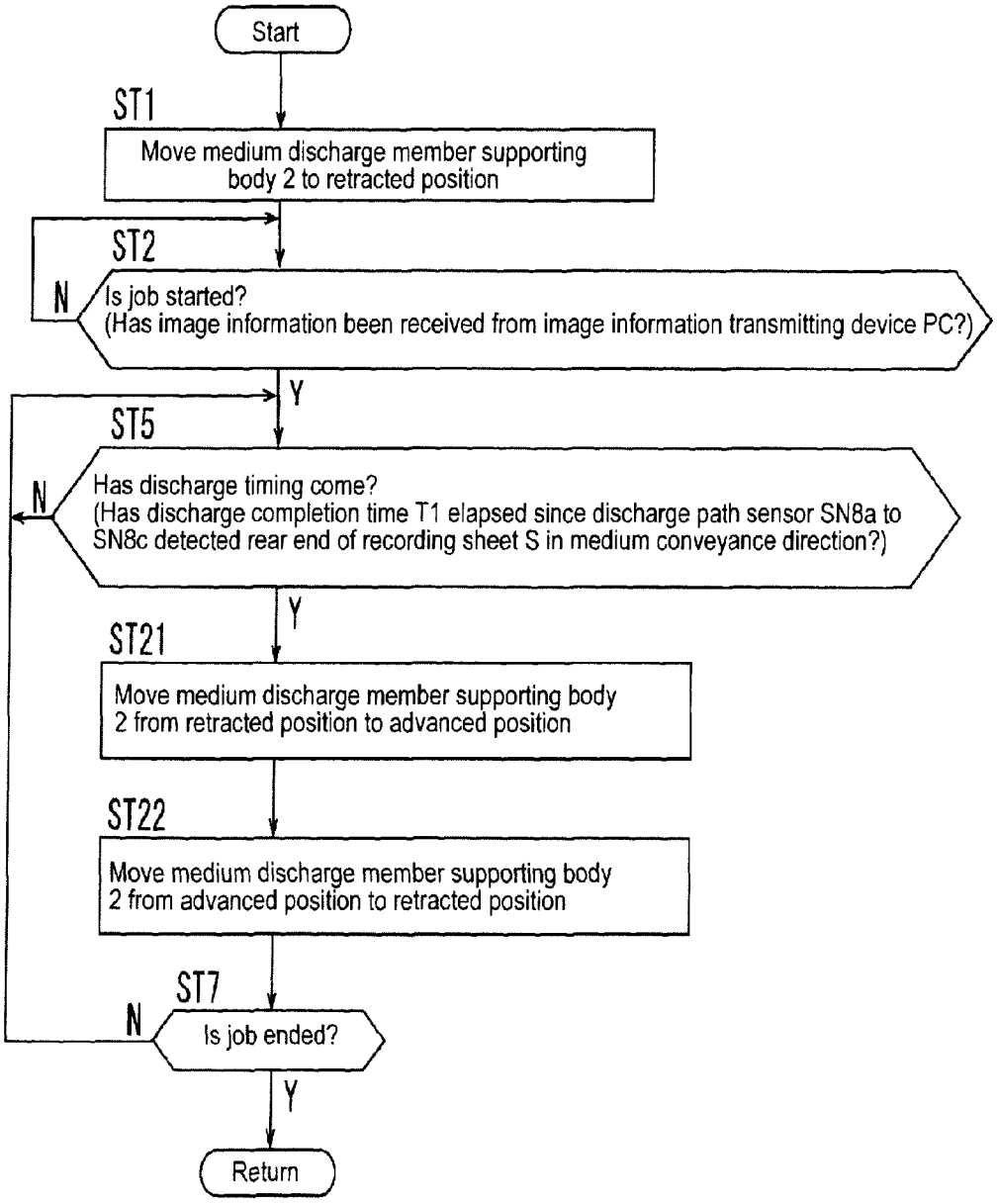
FIG. 10 is a flowchart of a separation member controlling process in Example 2, and corresponding to FIG. 6 in Example 1.

FIG. 10 is a flowchart of a separation member controlling process in Example 2 of the invention, and corresponding to FIG. 6 in Example 1.

In the flowchart of the separation member controlling process in Example 2, as compared with the flowchart of the separation member controlling process in Example 1, ST3 and ST4 are omitted, and ST21 and ST22 below are executed in place of ST6. The processes of the other steps ST1, ST2, ST5, and ST7 are similar to those of Example 1, and therefore their detailed description is omitted.

In ST21 of FIG. 10, the medium discharge member supporting body 2 is moved from the retracted position to the advanced position corresponding to the preset travel distance, via the gears 1*a*2, 2*a*2, 1*b*2, 2*b*2, Sf1, Sf2, the pins 1*a*1, 1*b*1, and the guide slots 2*a*1, 2*b*1 by forward rotation of the medium conveyance direction moving motor M2. Then, the process proceeds to ST22.

In ST22, the medium discharge member supporting body 2 is moved from the advanced position to the retracted position via the gears 1*a*2, 2*a*2, 1*b*2, 2*b*2, Sf1, Sf2, the pins 1*a*1, 1*b*1, and the guide slots 2*a*1, 2*b*1 by reverse rotation of the medium conveyance direction moving motor M2. Then, the process proceeds to ST7.

(Operation of Example 2)

Figure 11A:
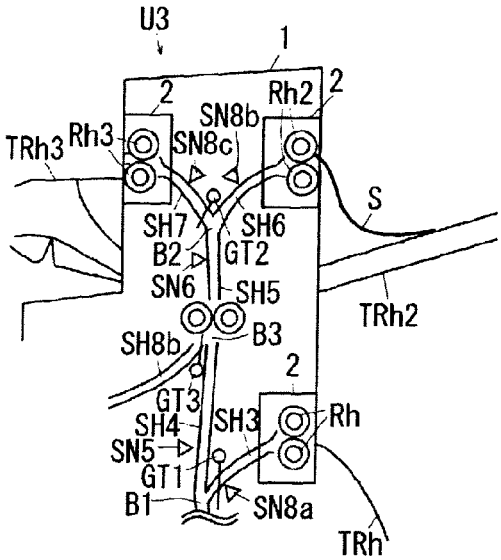
FIGS. 11A to 11C are diagrams illustrating operations of Example 2.
Figure 11B:
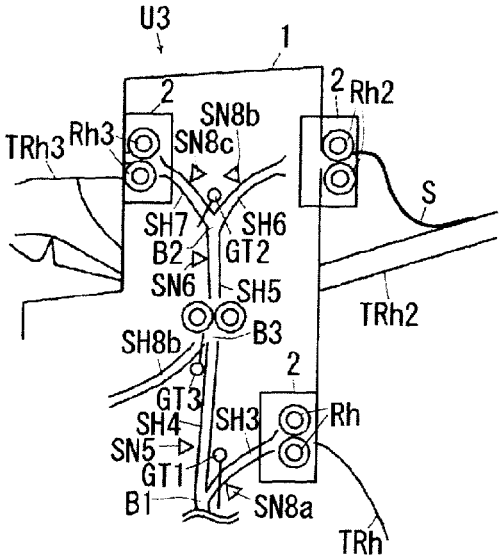
Figure 11C:
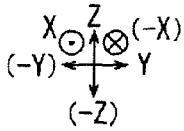
Figure 11C:
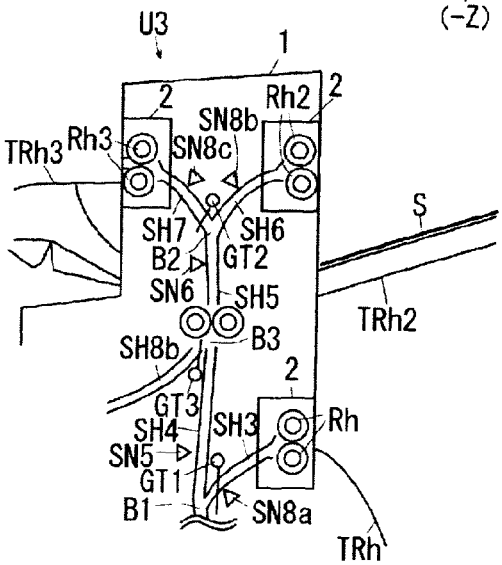

FIGS. 11A to 11C are diagrams illustrating the function of Example 2, FIG. 11A is a diagram of a state where the rear end in the medium conveyance direction of the recording sheet which is discharged by the inversion roll remains on the inversion roll, FIG. 11B is a diagram showing a state following the state of FIG. 11A, where the inversion roll is moved from the retracted position to the advanced position, and FIG. 11C is a diagram showing a state following the state of FIG. 11B, where the inversion roll is moved from the advanced position to the retracted position, and the recording sheet is dropped. When the medium discharge member supporting body 2 is located at the advanced position, a space is formed between the medium discharge member supporting body 2 and the tray TRH2 and below the medium discharge member supporting body 2.

In the thus configured printer U of Example 2, as shown in ST1 of FIG. 10, the medium discharge member supporting body 2 before the job execution is placed at the retracted position indicated by the solid line in FIG. 2. As shown in ST2 of FIG. 10, furthermore, even when image information is received from the image information transmitting device PC and the job is started, the medium discharge member supporting body 2 is placed at the retracted position.

The case where, as shown in FIG. 11A, the recording sheet S on which an image is recorded is conveyed to the face-down discharging path SH6 will be described. In this case, in the case where a discharge timing at which the recording sheet S is discharged from the discharge roll Rh, Rh2, or Rh3 comes as shown in ST5, ST21, and ST22 of FIG. 10, the medium discharge member supporting body 2 is moved from the retracted position to the advanced position, and then immediately returned to the retracted position. Even when, at the discharge timing, the rear end of the recording sheet S in the medium conveyance direction is attracted to and remains on the driving roll bodies 8 as shown in FIGS. 11B and 11C, therefore, the rear end of the recording sheet S in the medium conveyance direction is projected to the driving roll bodies 8 and thereafter immediately separated therefrom. Namely, the rear end is shaken and dropped, and then the recording sheet S is stacked on the face-down tray TRh2.

In the printer U of Example 2, also in the case where the recording sheet S on which an image is recorded is conveyed to the other discharging path SH3 or SH7 and discharged by the discharge roll Rh or Rh3, the medium discharge member supporting body 2 is moved in the sequence of the retracted position, the advanced position, and the retracted position in a similar manner as the case of the inversion roll Rh2 shown in FIGS. 11A to 11C, and the recording sheet S is shaken and dropped by the driving roll bodies 8, and stacked on the tray TRh or TRh3. In the printer U of Example 2, therefore, the discharged recording sheet S is prevented from remaining on the driving roll bodies 8.

Furthermore, the printer U of Example 2 achieves similar functions and effects as those of the printer U of Example 1.

MODIFICATIONS

Although, in the above, the examples of the invention have been described in detail, the invention is not restricted to the examples. Various modifications are enabled within the scope of the spirit of the invention set forth in the claims. Modifications (H01) to (H08) of the invention will be exemplified.

(H01) Although, in the examples, the printer U has been described as an example of an image forming apparatus, the invention is not restricted to this. The invention may be applied to a copier, a FAX, and a multi-function machine having a plurality of these functions. The invention is not restricted to an electrophotographic image forming apparatus, and may be applied to an image forming apparatus of an arbitrary image forming system, such as a printer of the inkjet recording system, the thermal head system, or the lithography system. The invention is not restricted to an image forming apparatus of the multi-color development system, and may be configured by a monochromatic image forming apparatus.

(H02) In the examples, the configuration where, in the offset discharge, the discharging apparatus body 1 and the like are moved integrally with the driving shaft 7 in the medium width direction in accordance with the movement of the discharge roll Rh, Rh2, or Rh3 has been exemplified. Alternatively, as described in JP-A-2005-96889, a configuration may be possible where the offset discharge is performed while the driving shaft 7 is not moved in the medium width direction, and a hollow shaft which is slidably supported by the driving shaft 7 is moved. In each of the discharge rolls Rh, Rh2, Rh3 in the examples, the corrugation rolls 6*b* are supported by the driven shaft portions 6*a*. Alternatively, as described in JP-A-2005-96889, a configuration may be possible where the corrugation rolls 6*b* are rotatably supported by the driven shaft portions 6*a*, or supported by the driving shaft 7, or the corrugation rolls 6*b* themselves are omitted.

(H03) In the examples, the inversion roll Rh2 and the face-up discharge roll Rh3 are configured in a similar manner as the discharge roller Rh. The invention is not restricted to this. For example, the face-up discharge roll Rh3 may have the configuration which is exemplified in modification (H02). In this way, the discharge rolls Rh, Rh2, Rh3 may have different configurations.

(H04) In the examples, the positions of the discharge rolls Rh, Rh2, Rh3 in the medium conveyance direction and the medium width direction are detected by using the sensors SNa, SNb. The invention is not restricted to this. For example, a configuration may be possible where the sensors SNa, SNb are omitted, and the travel distances of the discharge rolls Rh, Rh2, Rh3 in the medium conveyance direction and the medium width direction are controlled only by controlling the rotation amounts of the motors M2, 22.

(H05) In the examples, the discharge rolls Rh, Rh2, Rh3 are configured so as to be movable in the medium conveyance direction and the medium width direction. The invention is not restricted to this. For example, each of the discharge rolls Rh, Rh2, Rh3 may have a configuration where the offset discharging mechanism SC is omitted, and the roll is movable only in the medium conveyance direction.

(H06) In the examples, the case where the discharge position of the recording sheet S which corresponds to the discharge timing is the advanced position, and that where the discharge position is the retracted position have been exemplified. The invention is not restricted to this. For example, the invention can be applied also to a case where the discharge position is set between the advanced position and the retracted position. Namely, also in the case where the recording sheet S is discharged during the movement of the discharge roll Rh, Rh2, or Rh3 between the advanced position and the retracted position, a configuration where the rear end of the recording sheet S in the medium conveyance direction is separated from the driving roll bodies 8, or shaken and dropped therefrom by the driving roll bodies 8, so that the recording sheet S is stacked on the tray TRh, TRh2, or TRh3 may be possible.

(H07) In the examples, preferably, the discharge rolls Rh, Rh2, Rh3 are configured so as to be movable in parallel in the medium conveyance direction and the medium width direction. The invention is not restricted to this. For example, also a configuration where the discharge rolls are not moved in parallel in both the medium conveyance direction and the medium width direction can achieve the functions and effect of the invention. When vertical components are applied to the lateral components parallel to the medium width direction, for example, the rear-end separating mechanism KR may be movable in an obliquely upward rightward direction and an obliquely downward leftward direction. When components of the lateral direction which is the medium conveyance direction are applied to the anteroposterior direction which is the medium width direction, for example, the offset discharging mechanism SC may be movable in an obliquely right forward direction and an obliquely left rearward direction. For example, a configuration may be possible where the driven shaft portions 6*a* and the corrugation rolls 6*b* of the driven discharge roll 6 are rotated about the driving shaft 7 of the driving discharge roll 4. Namely, the rear end of the recording sheet S in the medium conveyance direction can be separated from the driving roll bodies 8, or shaken and dropped therefrom by swinging only the driven discharge rolls 6 while setting the driving shaft 7 as the rotation center. In a configuration where the whole medium discharge member supporting body 2 is swung while setting the driving shaft 7 as the rotation center, the rear end of the recording sheet S in the medium conveyance direction can be separated from the driving roll bodies 8, or shaken and dropped thereby.

(H08) In the examples, the rear-end separating mechanism KR shown in FIGS. 3 and 4 is configured by the pins 1*a*1, 1*b*1, the guide slots 2*a*1, 2*b*1, the gears 1*a*2, 2*a*2, 1*b*2, 2*b*2, Sf1, Sf2, the medium conveyance direction moving motor M2, etc. The invention is not restricted to this. For example, the gears 1*a*2, 2*a*2, 1*b*2, 2*b*2, Sf1, Sf2 and the medium conveyance direction moving motor M2 may be replaced with an elastic spring which is an example of a medium conveyance direction downstream urging member that urges the medium discharge member supporting body 2 toward the rightward advanced position, and an electromagnet solenoid that is an example of a medium conveyance direction upstream urging member in which the power source is ON/OFF controlled by the controller C, and which, when the power source is turned ON, moves the medium from the advanced position to the leftward retracted position against the urging force of the elastic spring. By contrast, the members 1*a*2, 2*a*2, 1*b*2, 2*b*2, Sf1, Sf2, M2 may be replaced with an elastic spring which is an example of a medium conveyance direction upstream urging member that urges the medium discharge member supporting body 2 toward the leftward retracted position, and an electromagnet solenoid that is an example of a medium conveyance direction downstream urging member in which the power source is ON/OFF controlled by the controller C, and which, when the power source is turned ON, moves the medium from the retracted position to the rightward advanced position against the urging force of the elastic spring.

What is claimed is:

1. A medium discharging device comprising:

a medium stacking portion on which a medium having an image recorded thereon is to be stacked;

a medium discharge member that discharges the medium to the medium stacking portion; and a moving mechanism that moves the medium discharge member and the medium, which is being discharged, in a medium width direction that is perpendicular to a medium conveyance direction, to adjust a stack position where the medium, which is being discharged, is to be stacked on the medium stacking portion, and that moves the medium discharge member only in a linear horizontal direction between an advanced position at a downstream end in the medium conveyance direction and a retracted position that is located upstream of the advanced position in the medium conveyance direction based on a discharging timing at which the medium is discharged from the medium discharge member.

2. The medium discharging device according to claim 1, wherein a discharge position that corresponds to the discharge timing is set in advance between the advanced position and the retracted position, and when the rear end of the medium is discharged from the medium discharge member, the medium discharge member is located at the discharge position.

3. The medium discharging device according to claim 2, further comprising:

a moving mechanism control section that controls the moving mechanism based on a travel distance, that is set in advance for a medium type of the medium, the travel distance being between the advanced position and the retracted position.

4. The medium discharging device according to claim 3, wherein the moving mechanism moves the medium discharge member and the medium in parallel, which is being discharged, in the medium width direction.

5. The medium discharging device according to claim 2, wherein the moving mechanism moves the medium discharge member and the medium in parallel, which is being discharged, in the medium width direction.

6. The medium discharging device according to claim 1, further comprising:

a moving mechanism control section that controls the moving mechanism based on a travel distance, that is set in advance for a medium type of the medium, the travel distance being between the advanced position and the retracted position.

7. The medium discharging device according to claim 6, wherein the moving mechanism moves the medium discharge member and the medium in parallel, which is being discharged, in the medium width direction.

8. The medium discharging device according to claim 1, wherein the moving mechanism moves the medium discharge member and the medium in parallel, which is being discharged, in the medium width direction.

9. An image forming apparatus comprising:

an image recording device that records an image on a medium;

a medium conveyance device that conveys the medium; and the medium discharging device according to claim 1, the medium discharging device that discharges the medium on which the image is recorded by the image recording device and which is conveyed by the medium conveyance device.

10. The image forming apparatus according to claim 9, wherein a discharge position that corresponds to the discharge timing is set in advance between the advanced position and the retracted position, and when the rear end of the medium is discharged from the medium discharge member, the medium discharge member is located at the discharge position.

11. The image forming apparatus according to claim 10, further comprising:

the moving mechanism moves the medium discharge member and the medium in parallel, which is being discharged, in the medium width direction.

12. The image forming apparatus according to claim 10, further comprising:

a moving mechanism control section that controls the moving mechanism based on a travel distance, that is set in advance for a medium type of the medium, the travel distance being between the advanced position and the retracted position.

13. The image forming apparatus according to claim 12, further comprising:

the moving mechanism moves the medium discharge member and the medium in parallel, which is being discharged, in the medium width direction.

14. The image forming apparatus according to claim 9, further comprising:

a moving mechanism control section that controls the moving mechanism based on a travel distance, that is set in advance for a medium type of the medium, the travel distance being between the advanced position and the retracted position.

15. The image forming apparatus according to claim 14, further comprising:

the moving mechanism moves the medium discharge member and the medium in parallel, which is being discharged, in the medium width direction.

16. The image forming apparatus according to claim 9, further comprising:

the moving mechanism moves the medium discharge member and the medium in parallel, which is being discharged, in the medium width direction.

* * * * *